US005658619A

United States Patent [19]

Kirschner et al.

[11] Patent Number: 5,658,619

[45] Date of Patent: Aug. 19, 1997

[54] METHOD FOR ADHERING RESIN TO BOTTLES

[75] Inventors: Jonathan Kirschner, Powder Springs; Acie Ray Fields, Danielsville; Stanley J. Puskarz, Athens, all of Ga.; William Leonard Roy, Milford, Conn.

[73] Assignee: The Coca-Cola Company, Atlanta, Ga.

[21] Appl. No.: 586,218

[22] Filed: Jan. 16, 1996

[51] Int. Cl.[6] ..... B05D 1/18

[52] U.S. Cl. ..... 427/512; 427/335; 427/389.7; 427/393.5; 427/430.1; 427/443.2; 118/423; 118/425; 118/428; 118/429; 118/501; 118/503; 118/642

[58] Field of Search ..... 427/512, 335, 427/393.5, 389.7, 430.1, 443.2; 118/423, 425, 428, 429, 503, 501, 642

[56] References Cited

U.S. PATENT DOCUMENTS

| | | | |
|---|---|---|---|
| 2,380,968 | 8/1945 | Kimmig et al. | 118/423 |
| 3,150,996 | 9/1964 | Johnson | 118/423 |
| 3,200,002 | 8/1965 | Lusher | 427/443.2 |
| 3,253,943 | 5/1966 | Mayer et al. | 118/423 |
| 3,734,765 | 5/1973 | Russell et al. | 118/423 |
| 3,898,355 | 8/1975 | Okeley, II et al. | 427/443.2 |
| 4,022,155 | 5/1977 | Campagna et al. | 118/503 |
| 4,575,915 | 3/1986 | Clark et al. | 29/509 |
| 5,211,992 | 5/1993 | Newton et al. | 427/512 |

FOREIGN PATENT DOCUMENTS

| | | | |
|---|---|---|---|
| 58-28216 | 6/1983 | Japan . | |
| 6-277612 | 10/1994 | Japan | 427/512 |

*Primary Examiner*—Katherine A. Bareford

*Attorney, Agent, or Firm*—Birch, Stewart, Kolasch & Birch, LLP

[57] ABSTRACT

A system and method for adhering resin to the exterior of the bottles includes a coating section, a flash-off section, and a curing section. In the coating section, the bottles are dipped in a solution of resin and solvent. Only the exterior of the bottles is coated. The bottles are fed from the coating section to the flash-off section where they will be conveyed along a zig-zag path. In the flash-off section, air will pass over the bottles in order to remove solvent from their exterior. The bottles are then fed to the curing section where they pass in front of a plurality of ultraviolet lights. The ultraviolet lights will cure the resin on the exterior of the bottles.

46 Claims, 23 Drawing Sheets

METHOD FOR ADHERING RESIN TO BOTTLES

BACKGROUND OF THE INVENTION

1. Field of the Invention

The present invention relates to a system and method for adhering resin to bottles. More specifically, the present invention relates to a system and method wherein bottles are fed to a coating section for dipping in a solution of resin and solvent. The bottles are then fed to a flash-off section where air flow passes over the bottles to remove the solvent. Finally, the bottles are fed to a curing section where ultraviolet lights cure the resin on the exterior of the bottles.

2. Description of the Background Art

In the beverage industry, many different types of containers are used for holding beverages. In certain locations, REFPET (REFillable Polyethylene Terephthalate) bottles are used. Certain countries have mandated that these bottles be recycled. Therefore, there is a need in the art for coating an exterior of these bottles so that they will maintain a good appearance throughout repeated uses. Accordingly, a system and method for coating REFPET bottles to protect them and to improve their aesthetic appearance are needed.

As the number of "trips" that a REFPET bottle makes into the consumer market increases, there is more opportunity for the bottle to become scuffed which would prevent further refilling and further use of the bottle. In order to help increase the number of trips available on average for REFPET bottles and to give the REFPET bottles a better overall appearance, there is a need to develop a method and system for applying a protective coating to REFPET bottles and for curing the coating on the bottles.

Japanese document 58-28216 discloses a system for coating the exterior of the bottles. In this system, however, the bottles are horizontally oriented. Therefore, gravity prevents a uniform coating from being applied on the bottles. There is therefore a need for a coating system which will more easily produce an improved coated bottle. The system should not be as complicated as that disclosed in Japanese document 58-28216 and the system should apply a uniform coating to the bottles for protection and aesthetic purposes.

Accordingly, a need in the art exists for a system and method for applying a coating to bottles. The system and method should uniformly apply the coating to the bottles. Both the thickness and height of the coating on the bottles should be standardized. Moreover, there is a need in the art to conserve the coating in order to minimize cost of the system and method. Space requirements for the system and method should be minimized so that it can be introduced into existing production lines. The processing time for coating the bottles should be minimized and the rate of bottle throughput should be easily varied while maintaining a uniform product output.

SUMMARY OF THE INVENTION

Accordingly, it is a primary object of the present invention to provide a system for adhering resin to bottles. This system includes a coating section for dipping bottles in a solution of resin and solvent to thereby coat an exterior of the bottles. The bottles are then fed to a flash-off section. In the flash-off section, a conveyor will receive the bottles. Means are also provided for removing solvent from the exterior of the bottles. The bottles are then fed to a curing section where they pass in front of means for curing the resin. This means can include ultraviolet lights which will cure the resin on the exterior of the bottles.

It is a further object of the present invention to provide a method for adhering resin to bottles comprising the steps of supplying the bottles to a coating section and gripping the bottles within this coating section. The bottles are then dipped in a solution of resin and solvent in the coating section. After removing the bottles from the solution, the gripping is terminated and the bottles are transferred to a flash-off section. A conveyor in the flash-off section moves the bottles through the flash-off section. During this time, solvent is removed from the exterior of the bottles. The bottles will then be transferred from the flash-off section to a curing section. In the curing section, resin on the exterior of the bottles will be cured. The bottles will then be discharged from the curing section.

Another object of the present invention is to provide a system for coating bottles. In this system, at least one container has a bottom opening through which a solution is introduced. Means are provided for jetting this solution through the bottom opening of the container. Means for supplying the bottles to the system is provided. Another means will grip the bottles from the means for supplying. This means for gripping is positioned over the opening in the bottom of the at least one container. Means are provided for vertically reciprocating the means for gripping to thereby dip the bottles into the solution. Finally, the means for supplying solution will expel any air entrapped beneath the bottles when they are dipped in the solution. This occurs due to the jetting of the solution into the at least one container. The exterior of the bottles will be in contact with the solution such that most of the bottle exterior will be completely coated.

Yet another object of the present invention is to provide a system for removing solvent from an exterior coating of the bottles. In this system, a conveyor is provided which moves along a zig-zag path. The conveyor has grippers for detachably holding the bottles. The bottles will move past means for removing solvent from the exterior of the bottles. This means for removing includes a fan for circulating air within the system. As the air passes over the bottles mounted on the conveyor, solvent will be removed from their exterior.

Still another object of the present invention is to provide a system for curing a coating on the exterior of the bottles. This system includes a curing section with a conveyor. The conveyor has grippers for releasably holding the bottles. Means are provided in the section for curing the coating on the exterior of the bottles. This means includes a plurality of lights mounted in the curing section. Means will drive the conveyor to move the bottles pass the plurality of lights. The speed of the conveyor will be controlled by the means for driving. The means for driving can selectively change the speed of the conveyor. Means are providing for adjusting a distance between at least one of the plurality of lights and the conveyor. This adjustment will be based on the speed of the conveyor and will ensure proper coating of the resin on the exterior of the bottles despite variations in the speed of the conveyor.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION ON THE PREFERRED EMBODIMENTS

Figure 1:
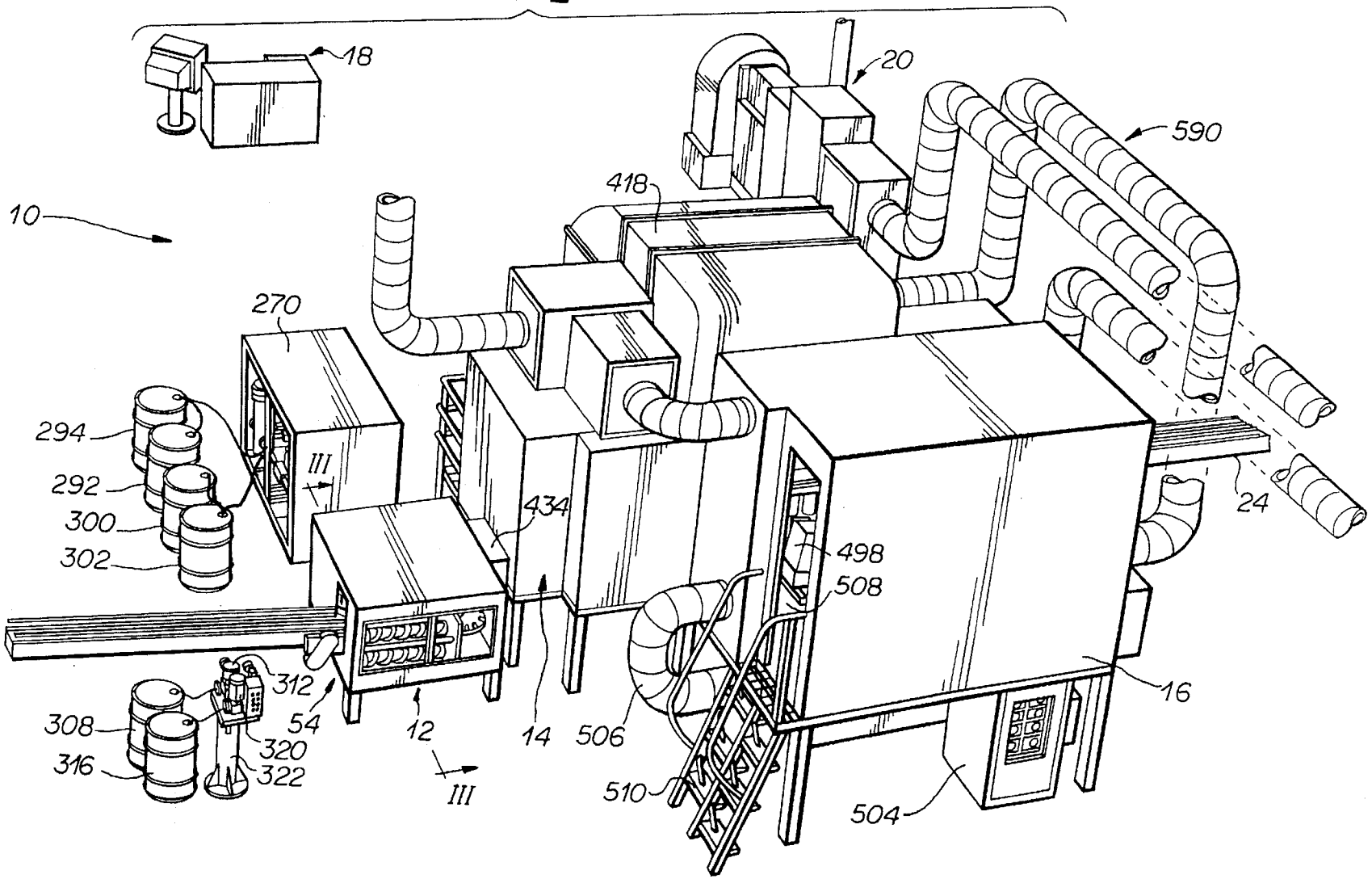
FIG. 1 is a perspective view of the entire system of the present invention.

Referring to the drawings and with particular reference to FIG. 1, a system 10 for adhering resin to bottles is shown. There are three major sections for this system 10. The first is a coating section 12. The bottles are dipped in a solution of resin and solvent in this section. Throughout this description, the solvent will be discussed as being alcohol, however, it should be appreciated that various other solvents could instead be used. Only the exterior of each bottle is coated with solution. Downstream from the coating section 12 is a flash-off section 14. The flash-off section 14 removes alcohol from the exterior of the bottles. Downstream from the flash-off section 14 is the curing section 16. After the flash-off section 14 removes alcohol from the exterior of the bottles, the resin will remain thereon. In the curing section 16, this resin will be cured to the exterior of the bottles.

A control 18 is provided for the system 10. The system 10 also includes an air-makeup system 20. Bottles are infed along conveyor 22 to the coating section 12. The bottles then flow to the flash-off section 14, the curing section 16 and to a discharge conveyor 24.

Figure 2:
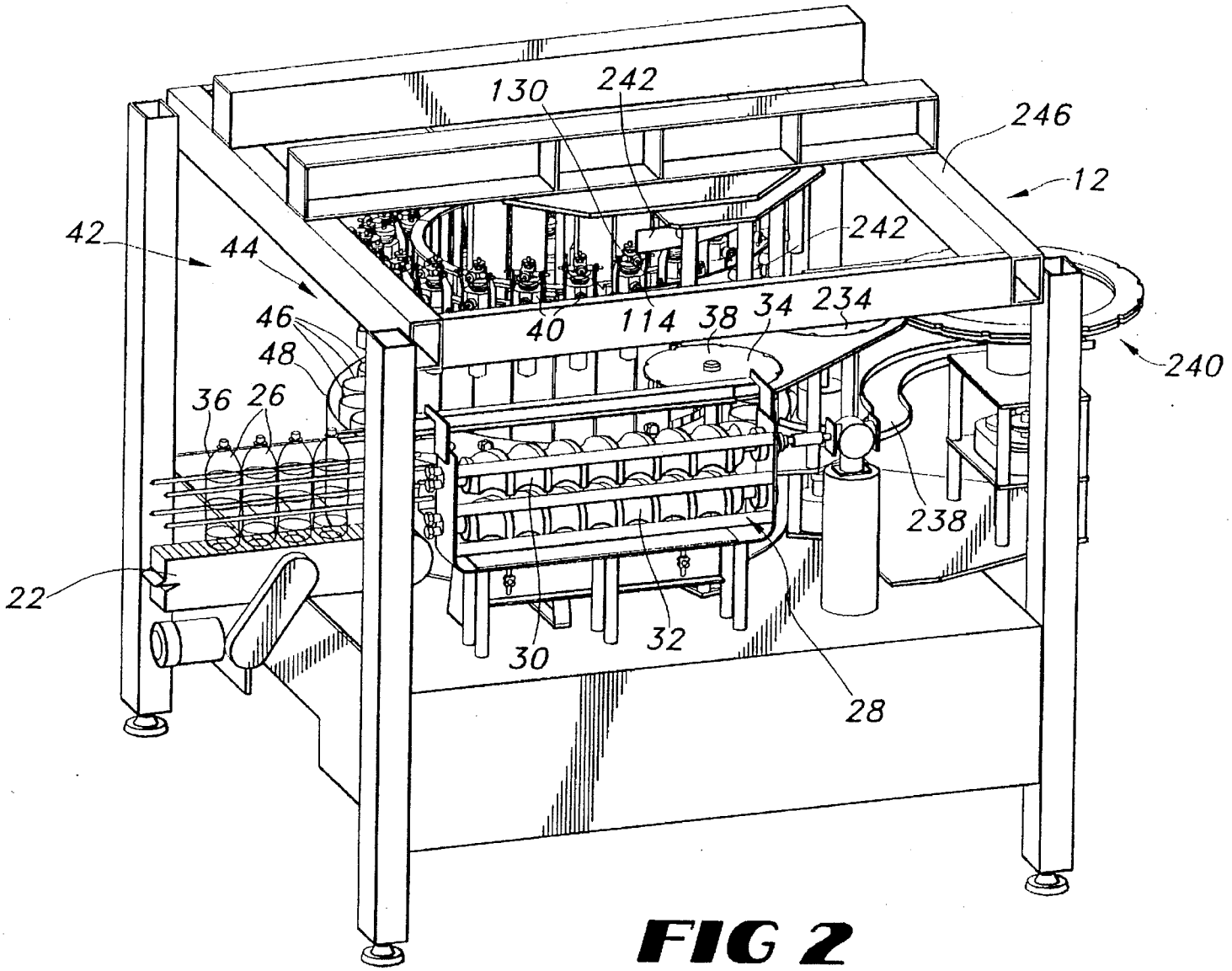
FIG. 2 is a perspective front view of the coating section of the present invention.

Turning now to FIG. 2, a plurality of bottles 26 can be seen on infeed conveyor 22. While a belt conveyor arrangement is shown for infeed conveyor 22, it should be appreciated that any know infeeding device can be used. The bottles will move from this infeed conveyor 22 to spacing auger 28. The spacing auger system 28 and/or the bottle infeed conveyor 22 are considered as means 54 for supplying bottles to the coating section 12.

The spacing auger system 28 includes a first auger 30 and a second auger 32. These augers 30, 32 will rotate simultaneously. Bottles 26 from infeed conveyor 22 will move through the spacing auger system 28 by rotation of the first and second augers 30, 32. This spacing auger system 28 will provide a predetermined space between sequential bottles.

From the auger system 28, the bottles 26 are fed to a first star wheel conveyor 34. As seen in FIG. 2, this first star wheel conveyor 34 will rotate in a counter-clockwise direction. The bottles will be gripped about their neck portion 36 such that the threads will be positioned above the top surface 38 of the first star wheel conveyor 34. This will leave the thread portion of the bottles 26 exposed for gripping by chucks 40 of the first star wheel conveyor 34.

Figure 3:
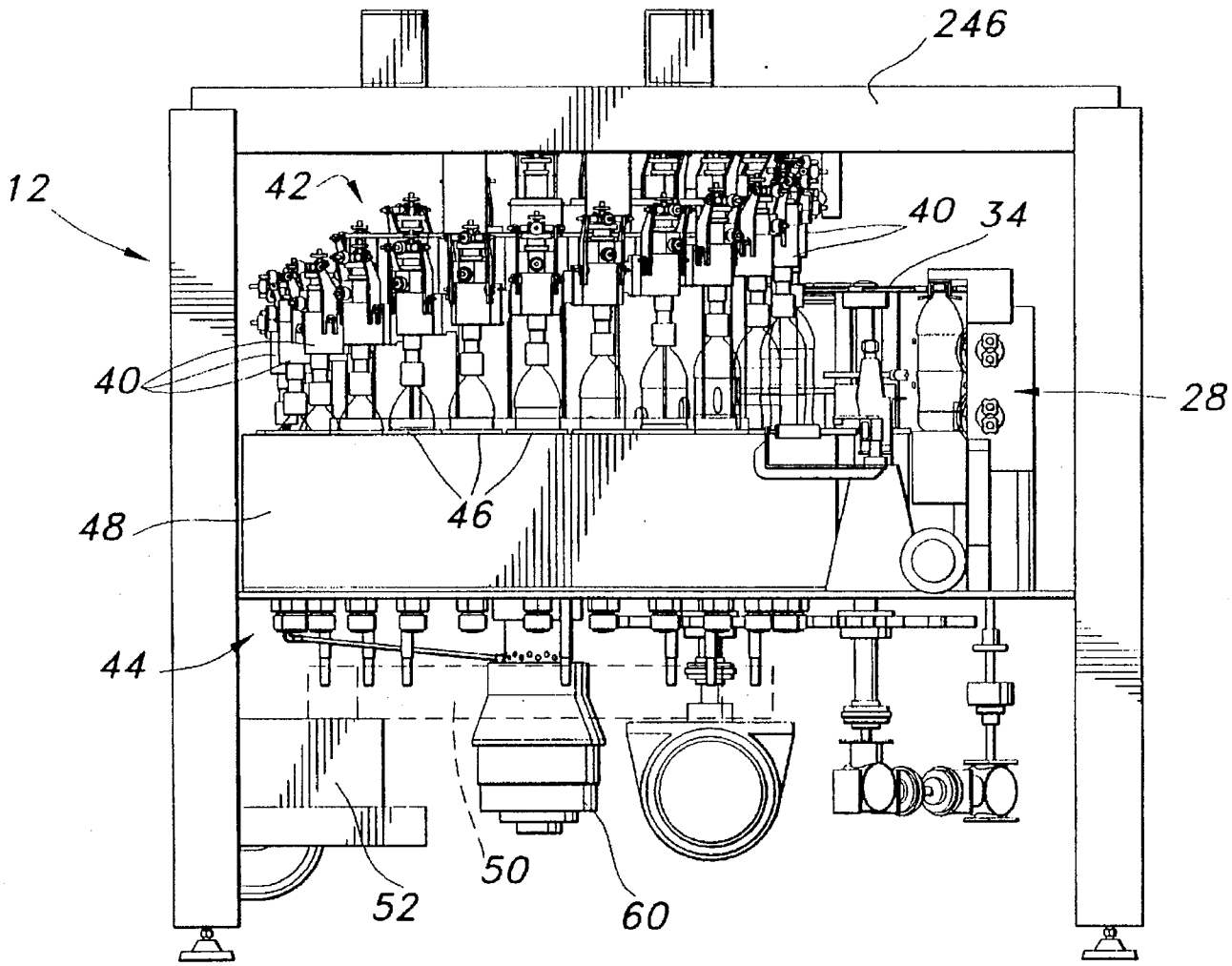
FIG. 3 is a left-side view of the coating section and a portion of the drive means taken along line III—III of FIG. 1 with the front cover removed.
Figure 4:
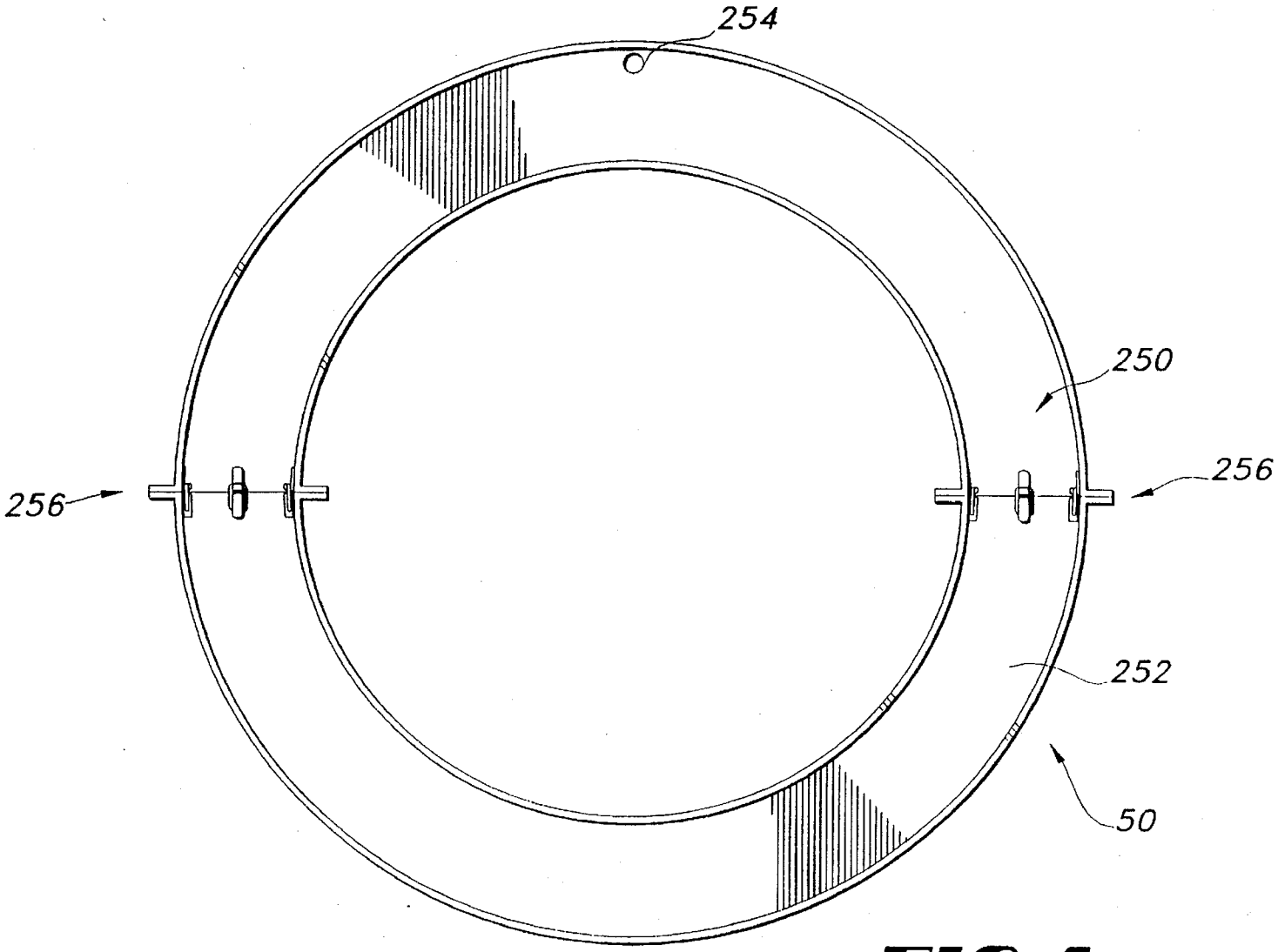
FIG. 4 is a perspective view of the stationary annular trough of the present invention.
Figure 5:
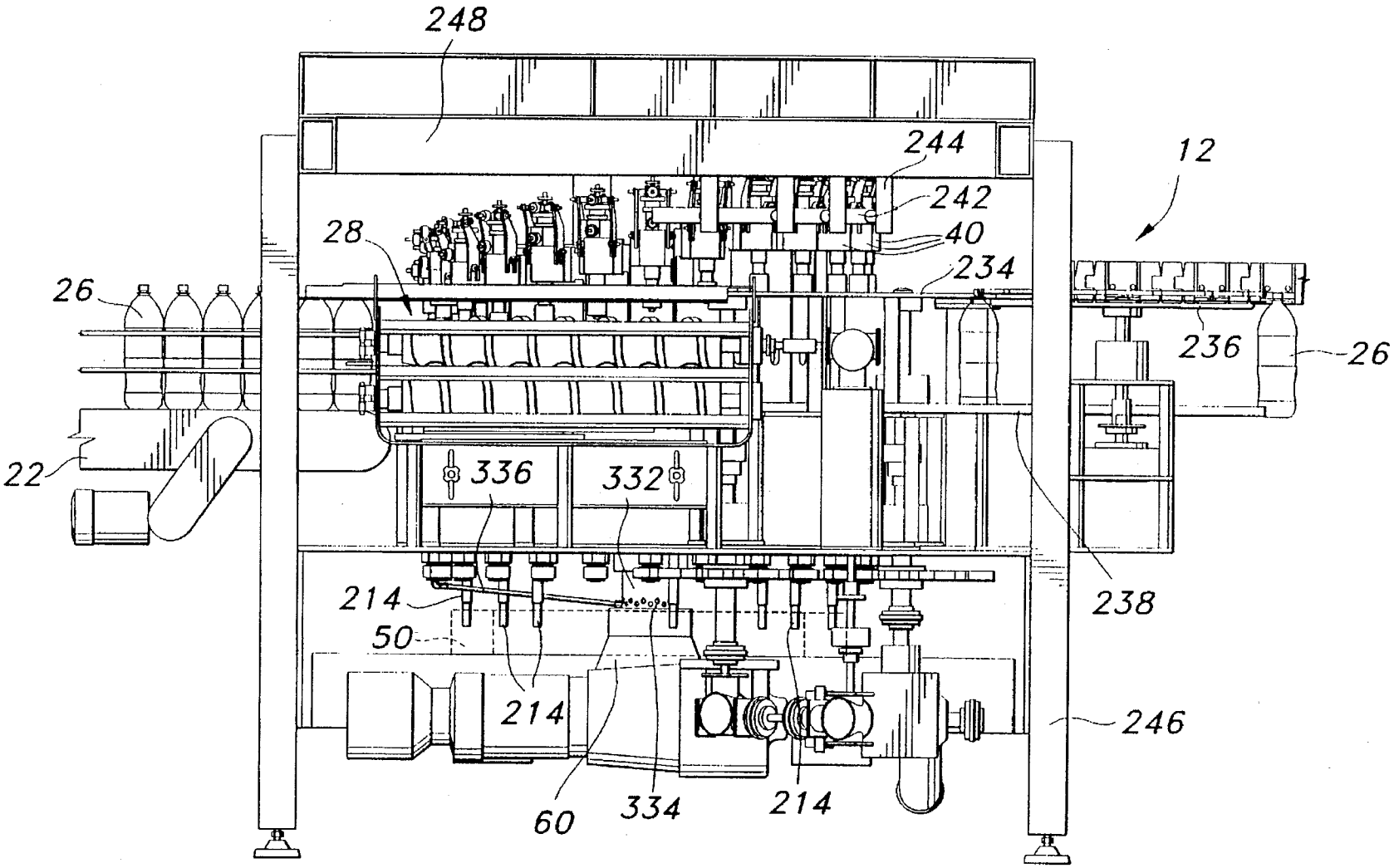
FIG. 5 is a front view of the coating section and a portion of the drive means of the present invention.

In FIGS. 3–5, a plurality of chucks 40 are shown. The chucks 40 are a part of means 42 for dipping bottles in solution. The means 42 includes the plurality of chucks 40, a rotatable turntable 44, a plurality of containers 46, a rotatable trough 48, a stationary annular trough 50 and a collection tank 52 as seen in FIGS. 2 and 3. These elements will be described in more detail below. In this means 42 for dipping, the chucks 40 are rotatable with the turntable 44 in a clockwise direction. Centrally disposed drive means 60 (to be described later) rotates turntable 44 at four revolutions per minute. The control 18 can, however, easily vary this speed.

Coating Section Chucks

Figure 7:
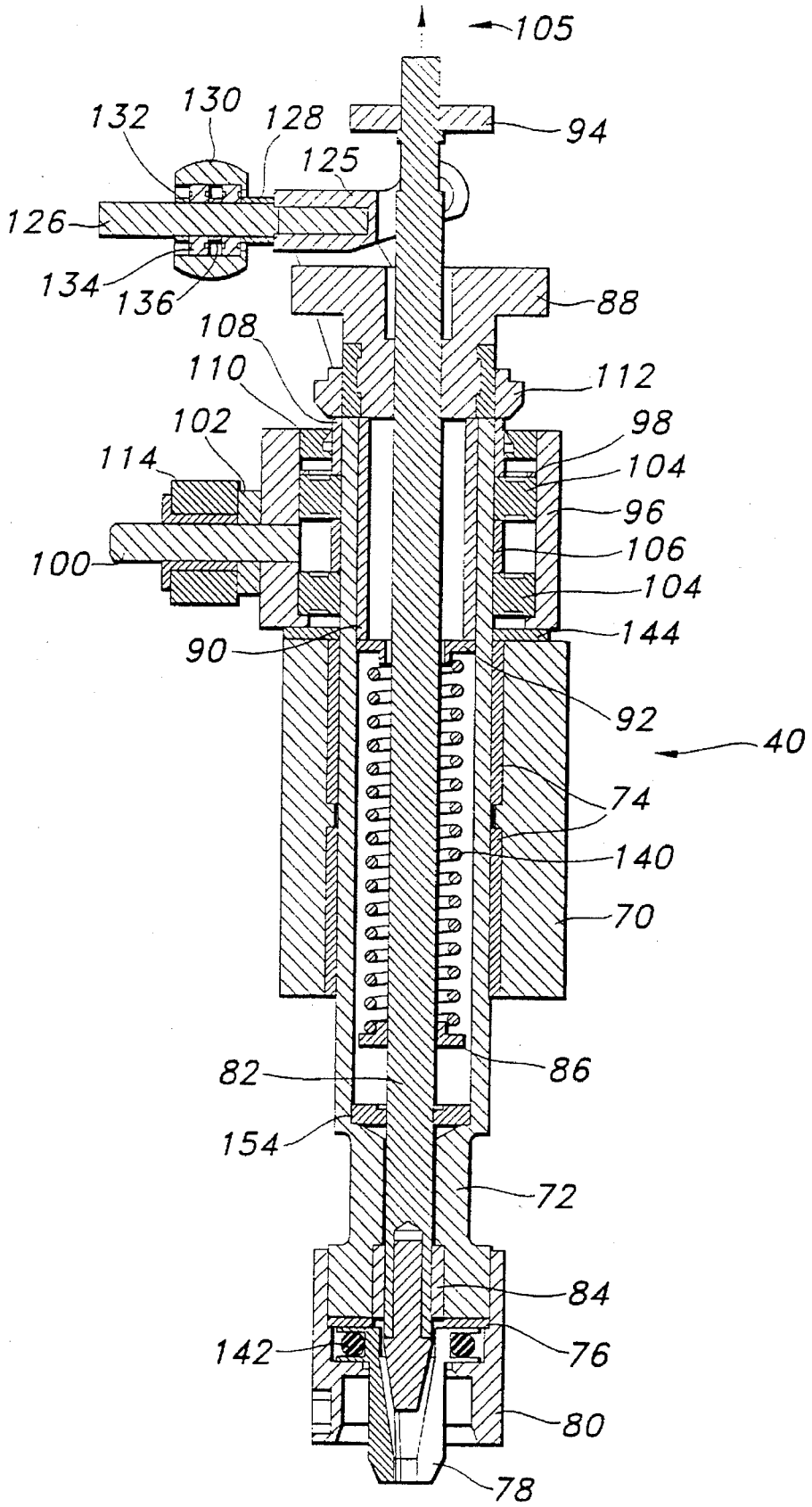
FIG. 7 is a cross-sectional side view of a chuck used in the coating section of the present invention.
Figure 8:
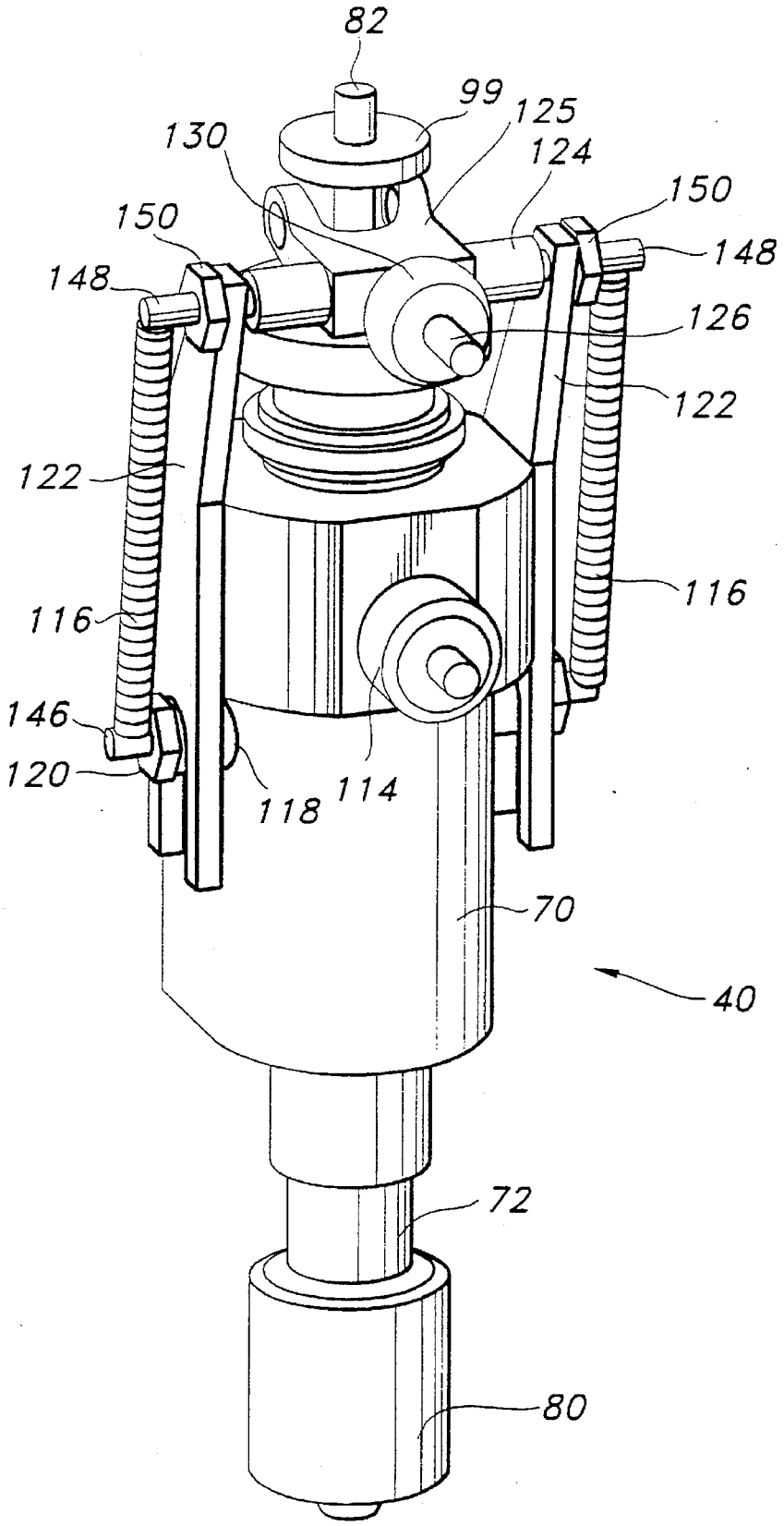
FIG. 8 is a front perspective view of the chuck of FIG. 7.

Turning to FIGS. 7 and 8, the chucks 40 will now be described in detail. The chucks 40 include a chuck housing 70. Within this housing 70 is spindle 72. The spindle 72 extends downwardly from the housing and has a thread shield 80 provided on its end. A bearing sleeve 74 is provided within the chuck housing 70. This bearing sleeve 74 is engaged with spindle 72. A spacer 76 is provided at the end of the spindle 72 within thread shield 80.

Centrally disposed within the chuck housing 70, spindle 72 and thread shield 80 is a center spindle 82. This center spindle 82 is longitudinally reciprocable within the chuck housing 70, spindle 72 and thread shield 80. A bearing sleeve 84 is provided at the end of the center spindle 82. Beneath this end of center spindle 82 is an expansion portion 78 for gripping an interior of bottles as will be described below. The expansion portion 78 is partially contained within thread shield 80.

Mounted on the center spindle 82 is a lower spring retainer 86. On the upper end of the center spindle 82 is a friction wheel 88. Extending from the frictional wheel 88 and coaxial with the center spindle 82 is a spring spacer 90. An upper spring retainer 92 is provided at the end of the spring spacer 90. Compression spring 140 extends between the upper spring retainer 92 and the lower spring retainer 86.

A spindle lifting ring 94 is provided at the uppermost end of the center spindle 82. Bearing housing 96 surrounds the spring spacer 90 and is coaxial with the center spindle 82. A retainer ring 98 is provided within the bearing housing 96. Stud 100 extends from this housing 96. A nut 102 is positioned on stud 100 adjacent housing 96. Bearing balls 104 are located within the bearing housing 96. These bearing balls 104 enable rotation of spindle 72 about a longitudinal axis 105. As will be described in more detail below, when friction wheel 88 is engaged with a frictional surface, the spindle 72 is rotated about the longitudinal axis 105. This rotation will therefore rotate a bottle 26 held by the chuck 40. This rotation will occur in the curing section 16 of the present invention.

A lower bearing spacer 106 and an upper bearing space 108 are provided within the bearing housing 96. Also, an oil seal 110 is provided at the upper end of the bearing housing 96. These elements are held together by a lock nut bearing 122. The bearing housing 96 is spaced from the chuck housing by a spacer 144.

A cam yoke roller or lower cam 114 is mounted on stud 100. This lower cam 114 will follow a cam track as will be described below.

As shown in FIG. 8, a tension spring 116 extends between lower stud 146 and upper stud 148. A spacer 118 and stop 120 are mounted on lower stud 146 between the lower end of support arms 122. A yoke 124 and stop 150 are provided on opposed sides of support arms 122 on the upper stud 148. A U-shaped assembly 125 is pivotally mounted on upper stud 148. Above lower cam 114, a cam roller or upper cam 130 is mounted on stud 126. These two cams 114, 130 are movable toward and away from one another in order to longitudinally reciprocate center spindle 82 relative to spindle 72 and chuck housing 70. The stud 126 for the upper cam 130 will pivot with upper stud 148. When the upper cam 130 moves downwardly toward the lower cam 114, the rear of the U-shaped assembly 125 will lift the center spindle 82 against the force of compression spring 140.

As seen in FIG. 7, stud 126 is mounted on the center spindle 82 by U-shaped assembly 125. The stud 100 with lower cam 114 is mounted on bearing housing 96. The roller 114 and stud 100 are rigidly interconnected with the spindle 72. Therefore, movement of roller 114 will cause spindle 72 to move. On the other hand, movement of roller 130 in the longitudinal direction will cause center spindle 82 to move relative to spindle 72.

A spacer 128 is provided on the stud 126. The spacer 128 positions the upper cam 130 away from the center spindle 82. Paths along which the upper cam 130 and lower cam 114 move are generally in the same plan as seen in FIG. 7.

A retaining ring 132, ball bearings 134 and spacer 136 are provided within the upper cam 130. Both the upper cam 130 and lower cam 114 are rotatable about their respective studs 100 and 126.

The compression spring 140 will urge the center spindle 82 downwardly. When the center spindle 82 moves downwardly, the lower end will engage the expansion portion 78 to radially spread it apart against the force of O-ring 142. This compression spring 140 therefore urges the rear of U-shaped assembly 125 downwardly to thereby move studs 126 and 100 with upper and lower cams 130, 114 away from one another. If the cams 130, 114 move along a cam track towards one another against the force of compression spring 114, the center spindle 82 will be lifted through the U-shaped assembly 125. The center spindle 82 moves upwardly relative to the spindle 72. This movement will cause the expansion portion 78 to contract due to O-ring 142. The lowermost end of the center spindle 82 will no longer push the expansion portion 78 outwardly.

In operation, the entire chuck 140 can be lowered along the longitudinal axis 105. The expansion portion 78 can be positioned within an opening in a bottle. The thread shield 80 will encircle the outer circumference of the opening. The thread shield can extend downwardly such that the threads on the upper end of the bottle are protected. For instance, the threads can be protected from the solution which will be applied to the exterior of the bottles as will be explained below.

Once the thread shield 80 is positioned over the outside of the bottle and the expansion portion 78 is positioned within the bottle, the cams 130, 114 can move along respective tracks. Spacing between the tracks is then reduced so that the cams 130, 114 move towards one another. This movement will cause the center spindle 82 to move upwardly in FIG. 7 along longitudinal axis 105. The center spindle 82 will move relative to the chuck housing 70, spindle 72 and thread shield 80.

When the cams 130, 114 disengage from the cam tracks as will be explained below, the cams 130, 114 will move away from one another forcing center spindle 82 downwardly. The downward movement of the center spindle 82 will urge the expansion portion 78 to expand circumferentially. This will engage the expansion portion 78 with the interior of the bottle and thereby hold the bottle between the expansion portion 78 and the thread shield 80. In this manner, a bottle can be firmly gripped by the chuck 40.

As noted above, the O-ring 142 is provided around the upper portion of the expansion portion 78. This O-ring 142 will urge the expansion portion 78 to a retracted position. When the center spindle 82 cams the expansion portion 78 circumferentially outward, the force of the O-ring 142 will be overcome. When the cams 130, 114 are moved toward one another, the center spindle 82 will move upwardly along axis 105 such that the end of the center spindle 82 will be retracted from the expansion portion 78. The O-ring 142 will cause the expansion portion 78 to contract and therefore release any bottles held between the expansion portion 78 and the thread shield 80 of the chuck 40. Besides an O-ring 142, any known arrangement can be used for urging the expansion portion 78 to the circumferentially retracted position.

With the chucks 40 of the instant invention, bottles 26 can be gripped. The rotatable chucks 40 acting with the upper and lower cams 130, 114 and the expansion portion 78 are considered as means 156 for engaging the interior of bottles in the instant invention. Chucks are used both in the coating section 12 and the curing section 16 of the instant invention as will be described in more detail below.

Coating Section

Returning to FIGS. 2–6, the coating section 12 of the instant invention will now be described in more detail. As previously noted, bottles are infed by bottle infeed conveyor 22 and spacing auger system 28 to the first star wheel conveyor 34. The threads of the bottles will be above top surface 38 of the first star wheel conveyor. This first star wheel conveyor 34 moves in a counterclockwise direction in FIG. 2. The bottles 26 will be rotated to a position adjacent the rotatable turntable 44. As seen in FIG. 3, the bottles will be positioned beneath one of the chucks 40 on this rotatable turntable. The threads the bottles will be exposed. The chucks 40 will be lowered in order that the thread shield 80 will encompass the threads at the top of the bottles 26. During this lowering, the expansion portion 78 will be positioned within the interior of the bottles. The chucks 40 will be operated in order to grip the bottles from the first star wheel conveyor 34. When gripped by chucks 40, the bottles will be transferred from the first star wheel conveyor 34 to the means 42 for dipping bottles in solution.

As noted above, this means 42 for dipping bottles in solution includes the chucks 40 with rotatable turntable 44, the plurality of containers 46, the rotatable annular trough 48, the stationary annular trough 50 and the collection tank 52. The chucks 40 are simultaneously rotated with the rotatable turntable 44. As indicated in FIG. 3, the chucks 40 are lowered as they move away from the first star wheel conveyor 34. In FIG. 3, the turntable 44 moves from right to left. In FIG. 2, the basic movement of the turntable would be in a clockwise direction.

On rotatable turntable 44, the rotatable annular trough 48 is provided. This rotatable annular trough 48 rotates with turntable 44 and contains the plurality of containers 46.

Figure 9:
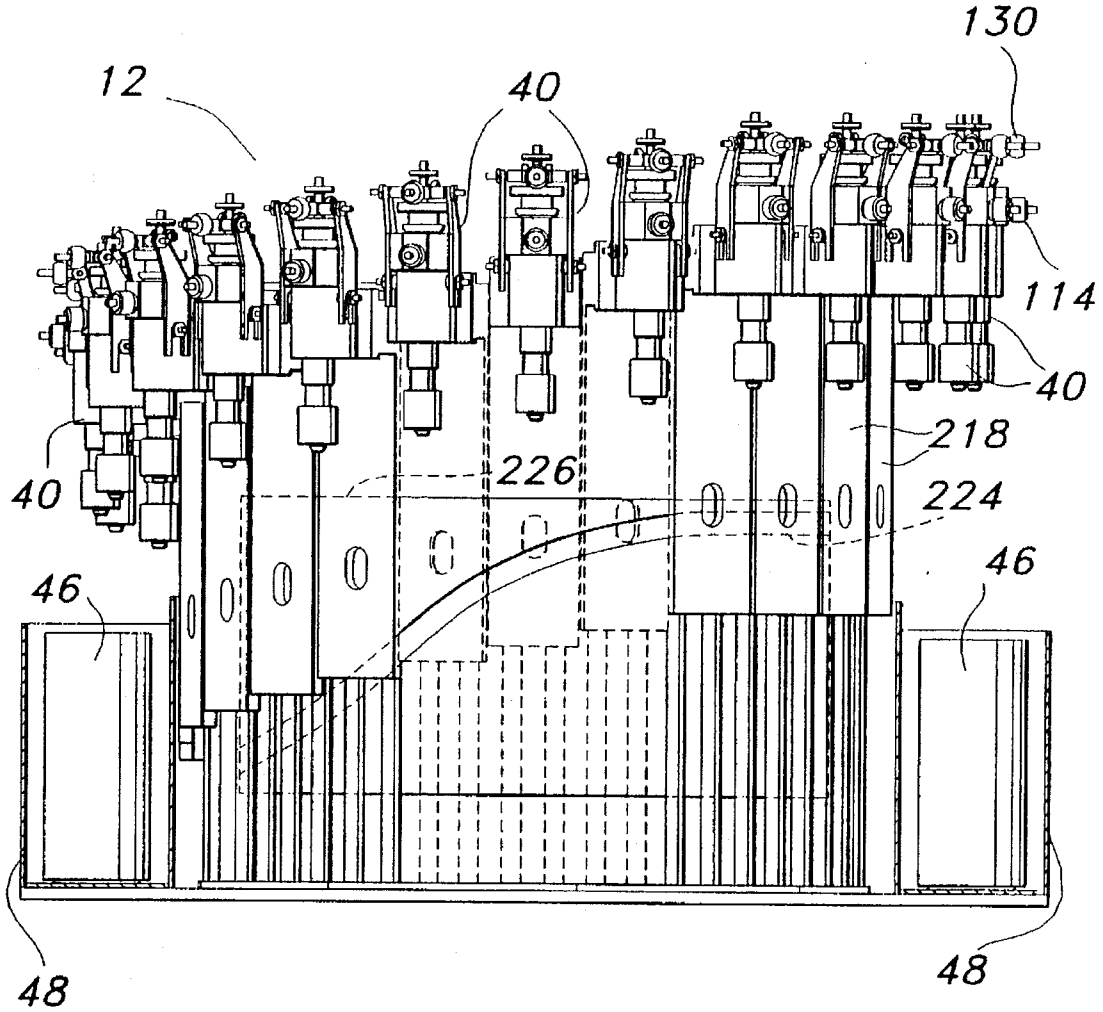
FIG. 9 is a partial sectional view taken from the left-side of the coating section showing a portion of the means for dipping bottles of the present invention.
Figure 10:
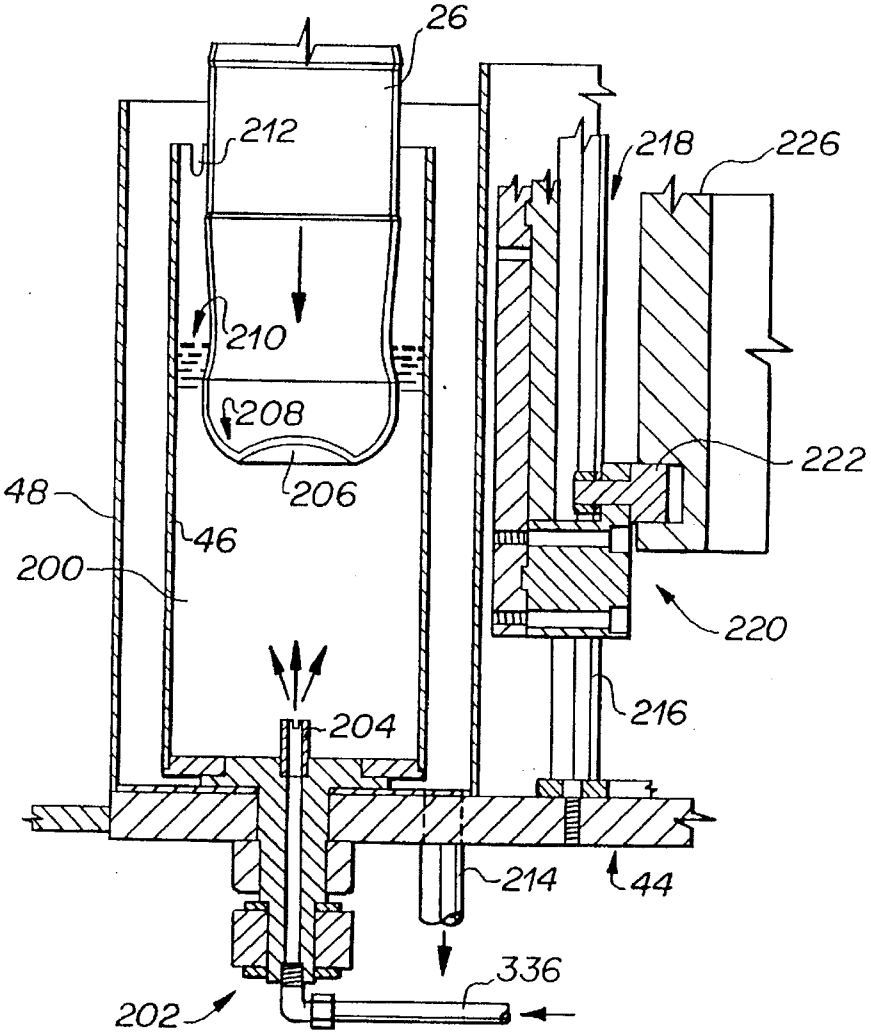
FIG. 10 is a sectional-view of a container and the means for supplying solution of the coating section of the present invention.

Turning to FIGS. 9 and 10, a section of the rotatable annular trough 48 is shown. The circularly arranged chucks 40 in FIG. 9 are not, however, shown in the section. The plurality of containers 46 are located within the rotatable annular trough 48. While only two containers 46 are shown in FIG. 9, it should be appreciated that these containers encircle the rotatable turntable 44. A total of twenty-four, evenly spaced, cylindrical containers are provided in the illustrated invention. Of course, this number, spacing, and shape of containers could be varied. Beneath each of the chucks 40, one container 46 is provided. The rotatable annular trough 48 is continuous in order to encircle the turntable 44 and to enclose the containers 46. The chucks 40 are aligned such that when moved longitudinally about their axis 105, they will dip bottles 26 into the container 46 positioned therebelow. The chucks 40, plurality of containers 46 and rotatable annular trough 48 are all simultaneously rotatable with turntable 44.

As indicated in FIG. 10, the bottles 26 will be lowered into the containers 46 by the chucks 40. Solution 200 is provided in each of the containers 46. This solution 200 is made up of at least a combination of resin and solvent such as alcohol. The resin will be cured by exposure to ultraviolet light.

Means 202 are provided for supplying solution 200 to the containers 46. This means 202 includes an opening 204 in the bottom of the container. Each of the containers 46 will have an opening 204 for the means 202 to supply solution. The longitudinal axis 105 of the chucks 40 is generally aligned with this opening 204. The containers 46 are detachably mounted on the turntable 44. A suitable seal prevents solution 200 from leaking out of the bottoms of the containers.

At the bottom 208 of bottles 26 is a concave portion 206. When the chucks 40 are vertically reciprocated along their longitudinal axis 105, the bottles will be dipped into the solution 200 in the container 46. During this time, air can be entrapped in this concave portion 206. Due to the solution jetting trough opening 204 from the means 202 for supplying solution, any air entrapped in this area 206 can be removed. Therefore, the bottom 208 of the bottle 26 can be completely coated with solution. A uniform coating of the bottles is therefore obtained.

The solution 200 is shown at a height 210 in FIG. 10. This height 210 of solution can be at any level. However, it is contemplated that each of the containers 46 will have the same height of solution so that all bottles handled by the system 10 will be coated to the same height. The means 202 helps control this height by supplying solution to the containers 46.

When the bottles 26 are dipped into the containers 46, the level of solution 210 rises. A notch 212 is provided at the upper edge of the container 46. This notch 212 will determine a maximum depth of solution in the containers. The predetermined height of resin in the container which is determined by notch 212 will correspond to the uppermost portion of the bottle to which solution is to be coated. This will help to ensure uniform coating of the bottles 26. Solution which overflows from notch 212 is caught in rotatable annular trough 48. A drain 214 is provided for collecting overflowing solution 200. As will be described below, this solution is recycled in order to minimize the amount of solution required by the system 10.

Instead of using notch 212, an adjustable ring could be used to set the final height of solution in container 46. This ring can sit on container 46. The top edge of the ring would determine the maximum depth of solution in the container. Alternatively, the ring can be screwed onto container 46. Depending upon how far the ring is screwed onto the container 46, the height of the solution therein will be determined. In other words, if the ring is only slightly screwed on the container 46, then a greater depth of solution will be held within the container 46. If, on the other hand, the ring is screwed more times onto the container, then the overall height of the ring plus container 46 will be less. Therefore, less solution can be maintained in the container 46 whereby the final height of solution can be determined. It should be appreciated that the screw connection between the ring and container 46 are liquid tight such that solution will not leak therethrough.

Of course, other than screwing the ring onto container 46, other suitable attachment arrangements could be used. For example, notches could be provided such that the ring will catch in different positions along the container 46. Depending upon the position at which the ring is set, the height of the container plus ring will be determined. This height thereby determines the total depth of solution in the container. Other possible arrangements for determining the maximum height of solution in container 46 should be apparent to those skilled in the art. While a notch 212 or adjustable ring have been discussed, any suitable means for determining a maximum depth of solution in container 46 can be used.

The shape of the container 46 is cylindrical and generally matches the shape of the bottle 26. Each of the containers 46 will receive one bottle 26. The containers are rotatable simultaneously with the chucks 40 and the annular trough 48 on rotatable turntable 44. The containers 46 will receive the bottles 26 by vertical movement of the chucks 40. Mounted on rotatable turntable 44 is a rod 216 on which the chucks 40 are reciprocated. While only one rod 216 is shown in FIG. 10, a pair of rods or any other suitable guide can be used to guide the chucks 40. The chucks 40 are mounted on movable members 218 which are mounted on the rods 216 which rotate with rotatable turntable 44. The members 218 are part of means 220 for vertically reciprocating the chucks.

The movable member 218 for the chuck has a follower 222 mounted thereon. The follower 222 is positioned within a follower track 224 as seen in FIG. 10. The follower track 224 has a certain path which will now be described.

Figure 11:
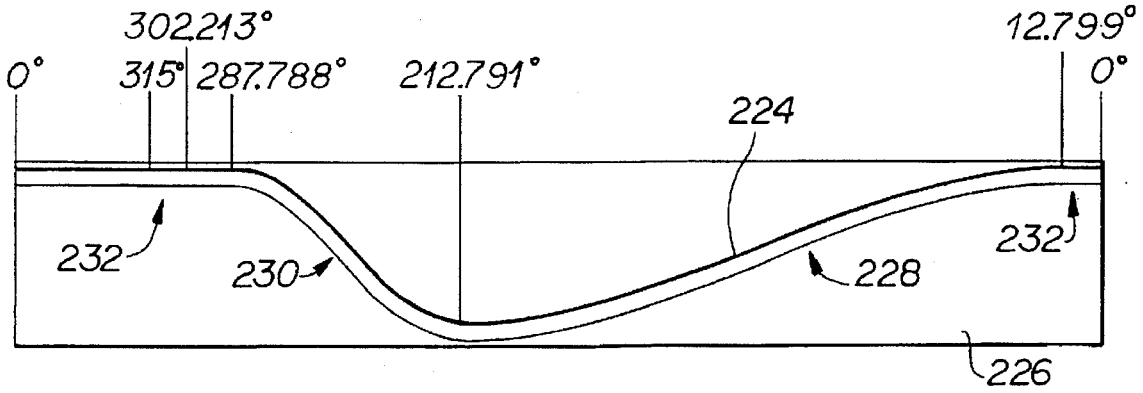
FIG. 11 is a view for explaining the path of the cam track in the coating section of the present invention.
Figure 12:
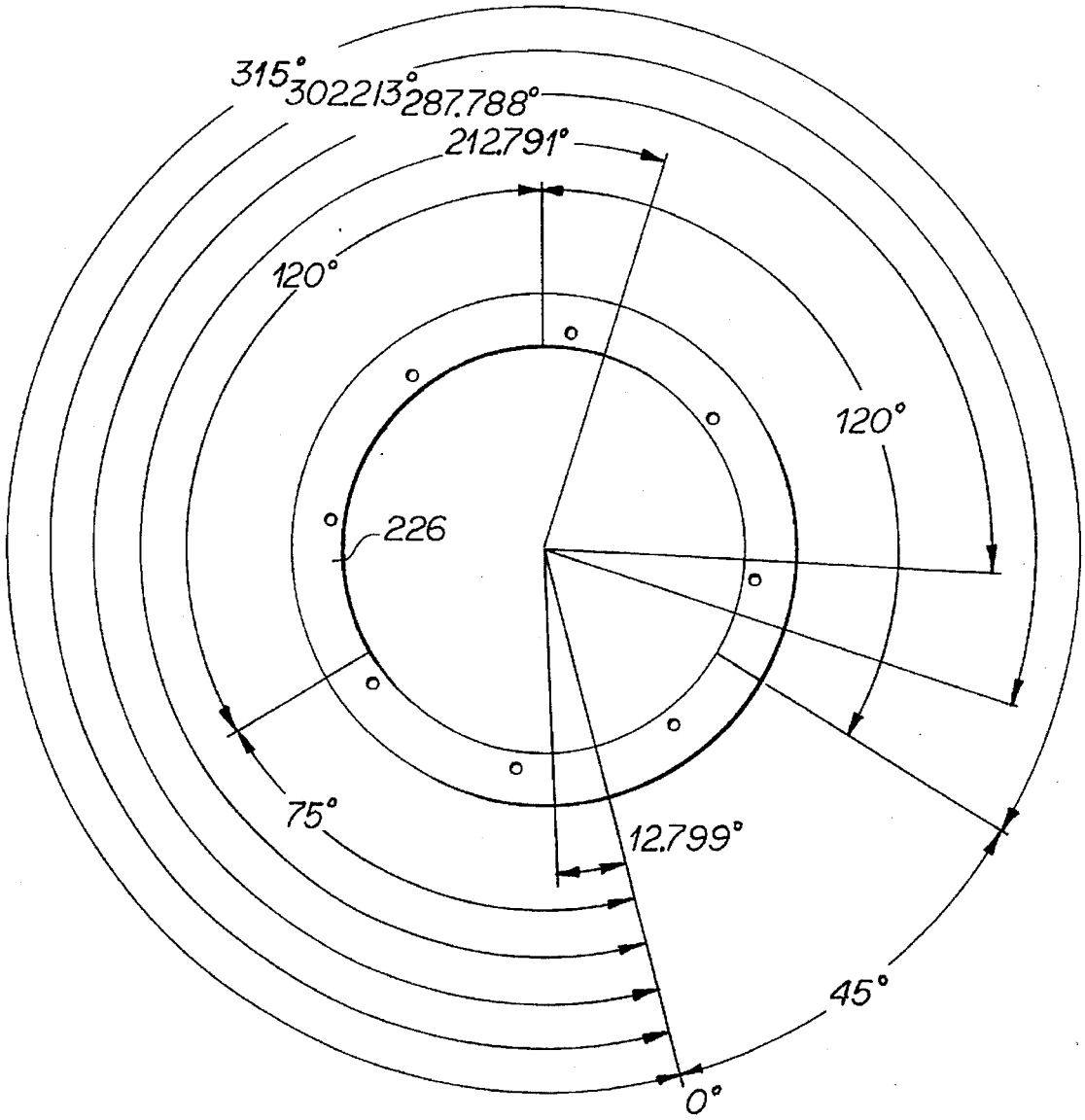
FIG. 12 is a top view of the cam cylinder having the cam track in the coating section of the present invention.

A cam cylinder 226 has the follower track 224 mounted thereon as shown in FIGS. 11 and 12. In FIG. 11, the cam cylinder 226 has been cut and flattened. It should be appreciated that this cam cylinder 226 is normally circular as shown in FIG. 12. This cam cylinder 226 is mounted within the rotatable turntable 44. The cam cylinder 226 remains stationary as the turntable 44 and chucks 40 rotate therearound. As the chucks 40 rotate around the cam cylinder 226, the follower 222 will follow track 224. Because the turntable 44 and chucks 40 move in a clockwise direction, the right-hand side of FIG. 11 is considered as the beginning of the path of movement for the chucks 40.

At 0° on the right-side of the cam cylinder 226 of FIG. 11, the follower 222 will begin its movement along track 224. The follower has a slight horizontal track portion 232. The track then has a downward portion 228 followed by an upper portion 230 and then returns to the horizontal portion 232. The right-hand horizontal portion 232 is connected to the left-hand horizontal portion 232 and is continuous therewith. The followers 222 for each of the chucks 40 can therefore rotate about this cylindrical cam cylinder 226. A plurality of followers 222 are simultaneously moving around track 224 because there are a plurality of chucks 40 on the turntable 44 around cam cylinder 226.

It should be noted that the upward track portion 230 is steeper than the downward track portion 228. This will result in gradual lowering of the followers and chucks 40. As the followers 222 gradually lower, the bottles will be gently immersed in the solution. The bottles are only immersed to a predetermined height. The maximum immersion occurs at point 212.791° where the downward track portion 228 changes to the upward track portion 230. The exteriors of the bottles are not completely coated with solution in containers 46. For example, the shield 80 on the chucks 40 ensures that the threads of the bottles are not coated with solution when they are dipped into containers 46. Only the exterior of the bottles are coated to the maximum predetermined height.

Nonetheless, the chucks 40 will gradually dip most of the exterior of the bottles into solution 200 in containers 46. This dipping will begin at position labeled 12.799° in FIG. 11. The dipping will continue to a position labeled 212.791° in FIG. 11. There is no dwell time for the bottles in the solution in the containers 46. Rather, when the followers 222 reach position 212.791°, they are immediately raised upwardly along upward track portion 230. At position 287.788°, the upward movement of the bottles is terminated. From this position to the left-handmost position labeled 0°, the chucks with their respective bottles will move horizontally without further vertical movement.

Because the upward track portion 230 is much steeper than the downward track portion 228, the bottles will be withdrawn from the solution 200 in containers 46 more rapidly than they are immersed therein. For example, it can take six seconds to lower the bottles and only three seconds to remove them. This slow immersion avoids splashing of solution from the containers 46. Also, the slow dipping of bottles helps to evenly coat the exterior of the bottles. A uniform coating thickness can be obtained.

FIG. 12, also indicates the various degrees around the cam cylinder 226 along which the followers 222 and bottles are moved. At 0° to 12.799°, the followers 222 will move along the horizontal track portion 232. From 12.799° until 212.791°, the bottles will be moved downwardly by the chucks 40 in order to be dipped in solution 200. From position 212.791° to position 287.788°, the bottles are lifted from the solution. This dipping and removing action takes a substantial portion of the circular path around cam cylinder 222. As noted before, this cam cylinder 222 is stationary while the rotatable turntable 44 and chucks 40 move therearound.

After the bottles reach position 287.788°, they will move along the horizontal track portion 232. Until position 302.213°, the bottles will be horizontally moved and held by chucks 40. This will enable any excess solution on the exterior of the bottles 26 to drip back into the underlying container 46. Therefore, solution 200 can be conserved in the instant system 10.

From position 302.213° to position 315°, the cams 114 and 130 on the chucks 40 will engage a cam track as will be described below with reference to FIG. 23. When engaging this cam track, the cams will be moved towards one another in order to release the expansion portion 78 from the interior of the bottles. The bottles will thereafter be transferred to a second star wheel conveyor 234 (shown in FIGS. 2 and 5). By position 315°, the bottles will be released from the chucks 40 and completely transferred to the second star wheel conveyor 234 as will be described below. From position 315° to position 0°, the chucks will be empty. At position 0°, the chucks 40 will receive another bottle 26 for repeating the dipping action.

It should be noted that while various exact positions around cam cylinder 226 have been indicated, these positions could be changed. For example, the portion of the path indicated from 287.788° to 302.213° where bottles travel horizontally and resin drips into the underlying containers 46 could be shortened, lengthened or simply omitted. Also, the bottles could be at maximum immersion at some position other than 212.791°. Therefore, one skilled in the art should appreciate that various modifications could be made to the cam cylinder 226.

This movement of chucks 40 is accomplished with a cam track 242 overlying a portion of the turntable 44 is a cam track 242 as seen in FIGS. 2 and 5. This cam track 242 is mounted on supports 244 held by coating section frame 246. The cam track 242 is rigidly mounted. The cam track 242 includes an upper and lower track as seen in FIG. 2. FIG. 5 only shows the lower track because the upper track is hidden beneath cross bar 248. Nonetheless, it should be appreciated that both upper and lower tracks 242 are provided. These tracks 242 are positioned above the rotatable turntable 44. The cam tracks 242 do not rotate with this turntable 44. Rather, as turntable 44 rotates with the chucks 40, the lower cam 114 and upper cam 130 of the chucks 140 engage these tracks.

Spacing between the two tracks 242 is such that the cams 130, 114 will move away from one another as the chucks 40 rotate away from the 0° position. This movement will cause the expansion portion 78 to grip the interior of the bottles. The expansion portion 78 will circumferentially enlarge due to movement of the center spindle 82 downwardly in spindle 72. In this enlarged position, the expansion portion 78 will hold the interior of the bottles. The opening at the top of bottles 26 will be held between the expansion portion 78 and the thread shield 80 of the chucks 40. The chucks will then rotate about the turntable. As can be seen in FIG. 2, the cam track 242 terminates whereafter the cams 130, 114 are at their maximally spaced positions. As the chucks are lowered in order to dip the bottles (which have been omitted from FIG. 2, for clarity), the cams 114, 130 will be urged away from one another by the force of compression spring 140.

As the chucks 40 rotate with turntable 44, they will be lowered in order to dip the bottles into the solution 200 in containers 46. The bottles will then be raised by the chucks 40. The cams 114, 130 on the chucks will then reengage the cam tracks 242 at position 287.788° as indicated in FIGS. 11 and 12. The distance between the two cam tracks 242 will be reduced in order to force the rollers 114, 130 towards one another. This will release the expansion portion 78 from the interior of the bottles. Thereafter, the bottles will be released from the chucks 40 and transferred to the second star wheel 234 for subsequent handling. Interaction between the cam tracks 242 and the cams 114, 130 will be described in more detail below with reference to FIG. 23 of the curing section.

Figure 6:
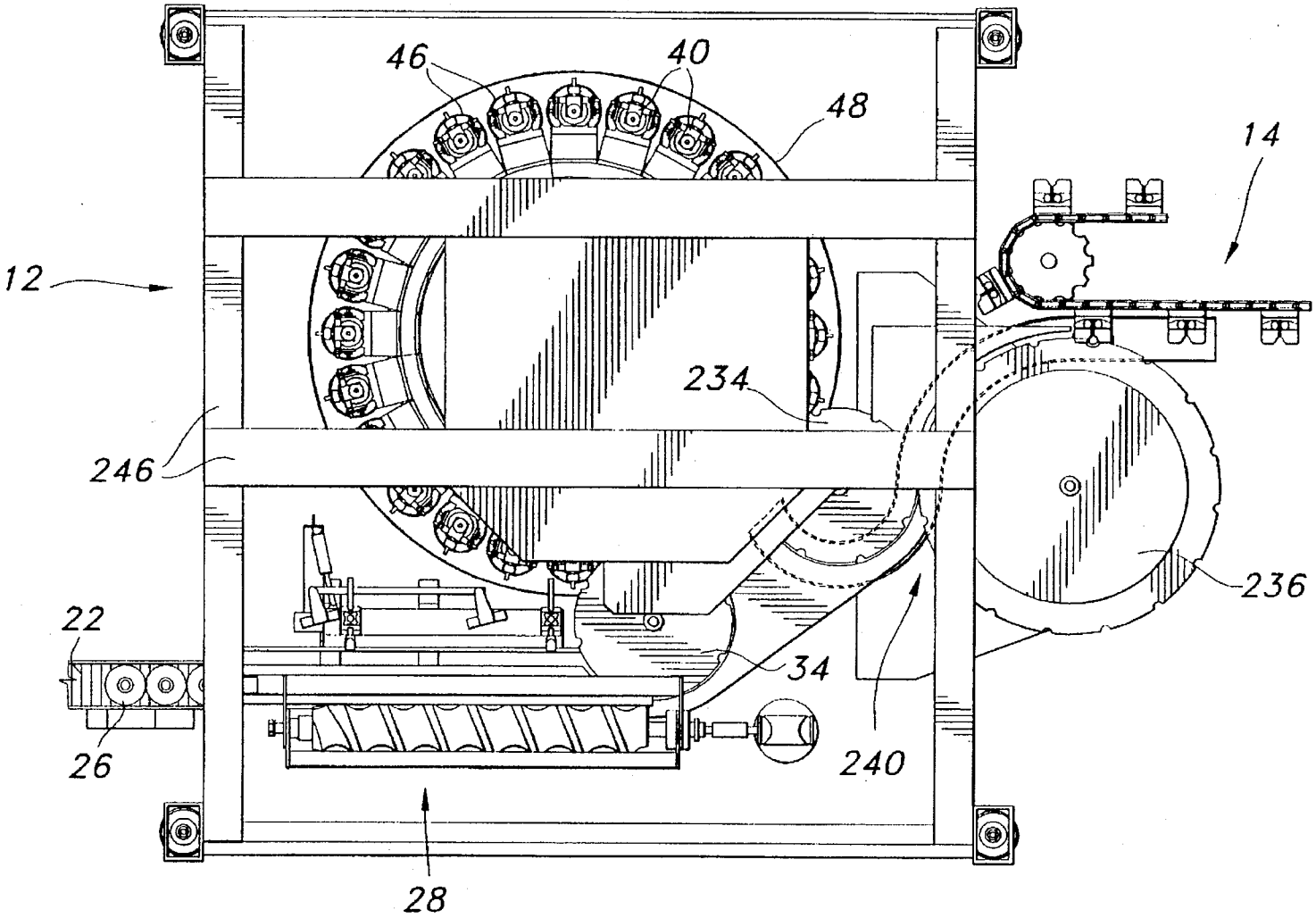
FIG. 6 is a top plan view of the coating section and means for transferring bottles from the coating section to the flash-off section of the present invention.

Referring to FIGS. 2, 3, 5 and 6, further handling of bottles 26 in the coating section 12 will be described. After being dipped in solution 200 in one of the containers 46, the bottles are transferred from chucks 40 to the second star wheel conveyor 234. In FIG. 6, the second star wheel 234 rotates counterclockwise about a central axis. The threads of the bottles will rest above the top surface of the second star wheel conveyor 234. From the second star wheel conveyor 234, the bottles will be fed to a third star wheel conveyor 236 as seen in FIG. 6. This conveyor 236 rotates in a clockwise direction. The third star wheel conveyor 236 will move bottles from the second star wheel conveyor 234 to the conveyor of the flash-off section 14. The second and third star wheel conveyors 234 and 236 move bottles along a S-shaped path.

As seen in FIG. 2, an S-shaped tray 238 is positioned beneath this path. Solution dripping from bottles 26 being handled by the second and third star wheel conveyors 234, 236 is caught by this S-shaped tray 238. The S-shaped tray 238 will return this solution to the means 202 for supplying solution. This S-shaped tray therefore helps to conserve solution in the system 10 of the instant invention. The second star wheel conveyor 234, the third star wheel conveyor 236, and the S-shaped tray 238 all act as means 240 for transferring bottles from the coating section 12 to the flash-off section 14.

In the discussion of FIG. 10, it was noted that any solution 200 which overflows from container 46 through notch 212 will be caught by the rotating annular trough 48. This solution will discharged from rotatable annular trough 48 through a plurality of drains 214. Such drains 214 are shown in FIG. 5. These drains 214 are rotatable with the annular rotatable trough 48 and the rotatable turntable 44. The drains 214 extend to the stationary annular trough 50. Eight drains 214 are provided around the bottom of the rotatable annular trough 48. Of course, any other suitable number of drains can be provided. These drains 214 can be small strips of tubing which extend outwardly from eight corresponding holes in the rotatable annular trough 48.

The stationary annular trough 50 is shown in dotted lines in both FIGS. 3 and 5. The stationary annular trough 50 is removable from the coating section 12. As shown in FIG. 4, the stationary annular trough 50 is divided into a first half 250 and a second half 252. An opening 254 for discharge of solution 200 from the stationary annular trough 50 is provided on the first half 250. This opening 250 can be located in any suitable position for discharge of solution 200 from the stationary annular trough 50 to the collection tank 52.

The two halves 250, 252 of the stationary annular trough 50 are connected together by fasteners 256. When connected together, the two halves will provide a fluid tight seal such that solution 200 received in stationary annular trough 50 will not leak through this joint. While two halves 250, 252 are shown, it should be appreciated that the stationary annular trough 50 can be broken into any number of sections. It is simply desired that this stationary annular trough 50 be separable in order to easily be removed from the coating section 12. When it is desired to removed the stationary annular trough 50 from coating section 12, it is simply necessary to release the fasteners 256. The two halves 250, 252 of the stationary annular trough 50 can be separated and then easily removed without disturbing the central drive means 60 for the rotatable turntable. The turntable 44 with the plurality of containers 46, rotatable annular trough 48 and chucks 40 are all rotatable about this centrally disposed drive means 60. This drive means 60 will be described in more detail below with reference to FIG. 26.

When mounted in the coating section 12, the stationary annular trough 50 is positioned beneath the rotatable annular trough 48. Both troughs 48, 50 generally have the same size. The opening 254 in the stationary annular trough 50 discharges fluid to collection tank 52 as indicated in FIG. 3. The stationary annular trough 50 is sloped such that fluid will flow by gravity in trough 50 towards opening 254 and then to the collection tank 52. The collection tank 52 can be a 30 gallon stationary tank. Any suitable size tank can, of course, be used.

Solution is collected in the collection tank 52 from the stationary annular trough 50. Therefore, solution overflowing from containers 46 will be caught by the rotatable annular trough 48, discharged by drains 214 to the stationary annular trough 50 and then discharged to the collection tank 52 through the opening 254 in the stationary annular trough 50. From the collection tank 52, solution 200 is circulated by solution handing system 270.

Solution Handling System

Figure 25:
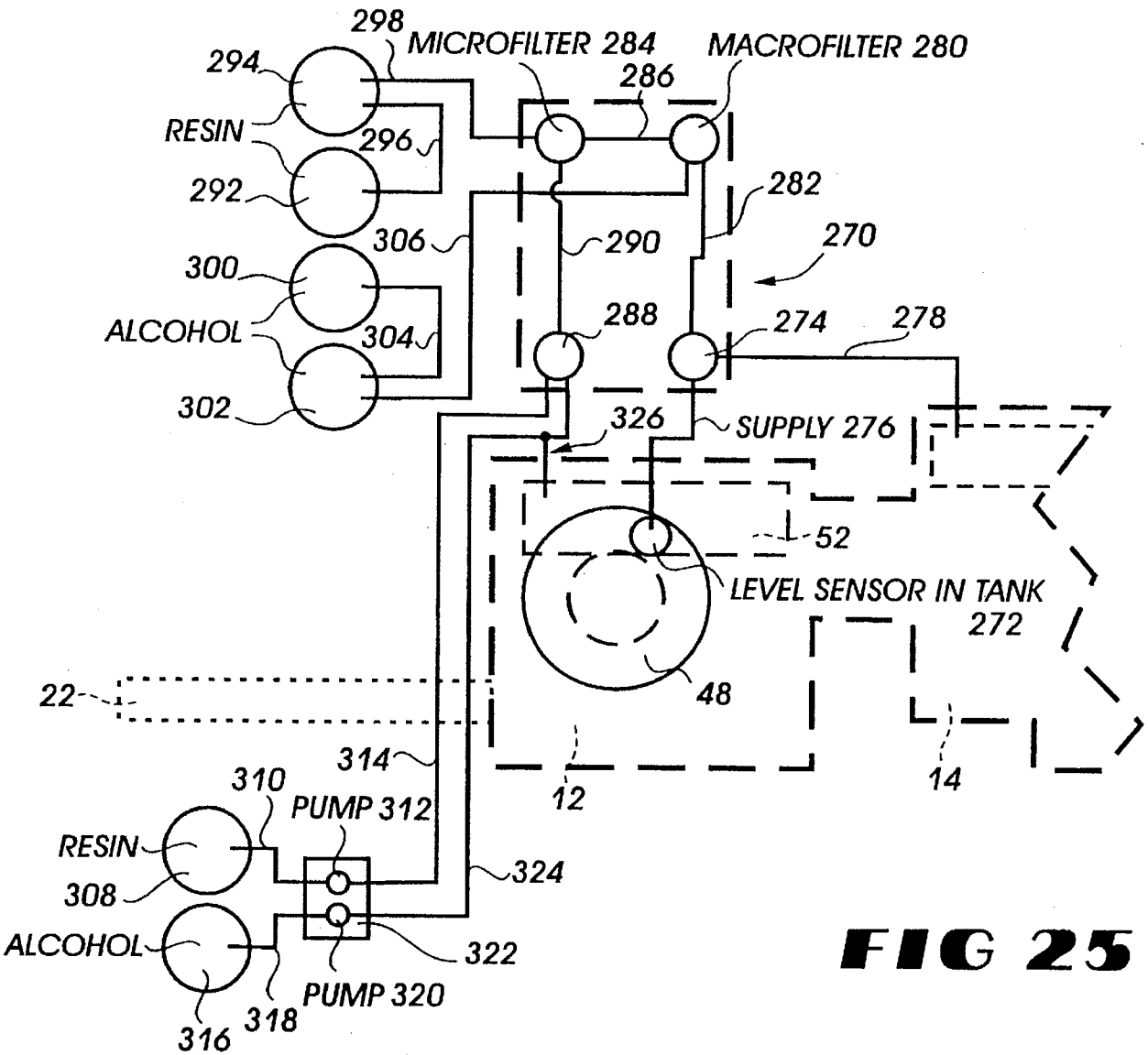
FIG. 25 is a schematic view of the solution handling system of the coating section of the present invention.

As shown in FIG. 25, this solution handling system 270 includes a level sensor 272 in tank 52. When the level of solution in tank 52 reaches a predetermined height, this level sensor will cause solution in tank 52 to be pumped to a density sensor 274 through supply line 276. This density sensor 274 will check the density of solution. When the mix (density) of solution is off, additional resin or alcohol can be fed to the system as will be explained below. This sensing of the mix of alcohol and resin in solution 200 is carried out by the density sensor 274.

A separate supply line 278 is provided from flash-off section 14. Solution which is caught in flash-off section 14 will be fed to the density sensor 274 through this line 278. Collection of solution within the flash-off section 14 will be described in detail below.

From the density sensor 274, solution is supplied to a macrofilter 280 through supply line 282. Solution is then fed to microfilter 284 through supply line 286. From the microfilter 284, solution will move to a heater/cooler 288 through supply line 290. This heater/cooler will maintain the temperature of the solution at about 75° F. Any suitable temperature for the solution, however, can be maintained.

Instead of using only a single macrofilter 280 and microfilter 284, a series of filters in parallel could instead be used. Other fluid circuits for the solution should also be apparent to those skilled in the art.

A first resin supply 292 is connected to a second resin supply 294 by an interconnection line 296. This second resin supply 294 is connected to the microfilter 284 through line 298. These resin supplies 292, 294 will supply additional resin to the solution handling system 270.

Similarly to the resin supply, a first alcohol supply 300 and second alcohol supply 302 are interconnected by interconnection line 304. The second alcohol supply 302 is connected to the macrofilter 280 through line 306.

While the two resin supplies 292, 294 and two alcohol supplies 300, 302 are shown, it should be appreciated that any number of supplies can be used. As indicated in FIG. 1, these supplies can be, for example, barrels of resin and alcohol. Alternative containers for the alcohol and resin can of course be used. Moreover, rather than serially interconnecting the various barrels through interconnection lines 296, 304, each barrel could instead, individually be connected directly to the solution handling system 270. Moreover, the second resin supply 294 is indicated as being connected to the microfilter 284. This resin supply, however, could be supplied to any portion of the solution handling system 270. Similarly, the second alcohol supply 302 is shown as being connected to the macrofilter 280. This alcohol supply could, however, be connected to any other portion of the solution handling system 270.

Also connected to the heater/cooler 288 is a supplemental alcohol and resin supply. In particular, supplemental resin supply 308 is connected to resin pump 312 through line 310 as shown in FIGS. 1 and 25. The resin pump 312 is then connected to the heater/cooler by line 314.

A supplemental alcohol supply 316 is also provided. This supplemental alcohol supply 316 is connected to an alcohol pump 320 by supply line 318. The supplemental resin supply 308 and the supplemental alcohol supply 316 are barrels. Of course, any suitable container for the supplemental supplies can be used. The pumps 312, 320 are mounted on support 322. While the interconnection is not shown from the pumps 312 and 320 in FIG. 1, this interconnection is indicated in FIG. 25. The alcohol pump 320 is connected downstream from the heater/cooler 288 by supply line 326. Solution is fed from the heater/cooler 288 and also from the supplemental alcohol supply 308 through line 324 to the supply line 326. This supply line 326 feeds the means 202 for supplying solution to the plurality of containers 46.

The supplemental resin supply 308 and supplemental alcohol supply 316 can be omitted, if so desired. Also, they can be located at any desired position and their supply lines 314, 324 can be connected to the solution handling system 270 in any desired location. In fact, the alcohol supply line 324 is shown as being connected downstream of the heater/cooler 288. Instead, this alcohol supply line 324 can be connected directly to the heater/cooler in order to insure an appropriate temperature of solution is fed to the supply line 326.

The density sensor 274 detects density of solution 200 as noted above. If additional alcohol or resin is needed in order to obtain the appropriate density, this density sensor 274 can activate the resin or alcohol supplies 292, 294, 300, 302 as well as the supplemental resin and alcohol supplies 308, 316. In this manner, an appropriate mix of solution can be obtained. Moreover, the control 18 can change the desired density for solution 100. In other words, the density sensor 274 can be programmed to obtain a first predetermined density for solution 200. Then, the control means 18 can change the desired density such that the density sensor 274 will obtain a second predetermined density. This first predetermined density and second predetermined density would be different.

The first and second resin supplies 292, 294, various supply lines and pumps (not shown) for moving the resin act as resin supply means 328 for selectively supplying resin to the solution supply means 202 through supply line 326. The first and second alcohol supplies 300, 302 as well as their various interconnecting supply lines and supply pump (not shown) act as an alcohol supply means 330 for selectively supplying alcohol to the solution supply means 202 through the supply line 326. The supplemental resin supply 308 can also be considered as a part of the resin supply means 328. Similarly, the supplemental alcohol supply 316 can be considered as a part of the alcohol supply means 330. These supplemental supplies can be manually controlled through the pumps 312, 322, if so desired. Alternatively, the supplemental supplies can be controlled by the control 18.

As seen in FIG. 5, a centrally disposed portion 332 of turntable 44 has a plurality of openings 334 provided thereon. One connection line 336 is shown from one of these openings 334. This connection line 336 is shown in FIG. 10 interconnected to the means 202 for supplying solution to the opening 204 in the container 46.

Therefore, supply line 326 in FIG. 25 is fluidly connected to the centrally disposed portion 332 in order to supply solution to the connection lines 336. Each container 46 has one connection line 336 provided therefor. These connection lines 336 are rotatable with the centrally disposed portion 332 of the turntable 44. A known valve interconnects non-rotatable stationary line 326 and the rotatable portion 332.

Through the solution handling system 270, solution 200 can be circulated in the coating section 12. The appropriate portions of alcohol and resin are maintained in the solution 200. Bottles will be infed by conveyor 22 to the coating section 12, rotated around turntable 44 while being held by chucks 40. The bottles 26 will be simultaneously dipped in solution 200 in containers 46. The bottles will be removed from the chucks by the first and second star wheel conveyors 234 and 236 which act as part of the means 240 for transferring bottles to the flash-off section 14.

Flash-off Section

Figure 13:
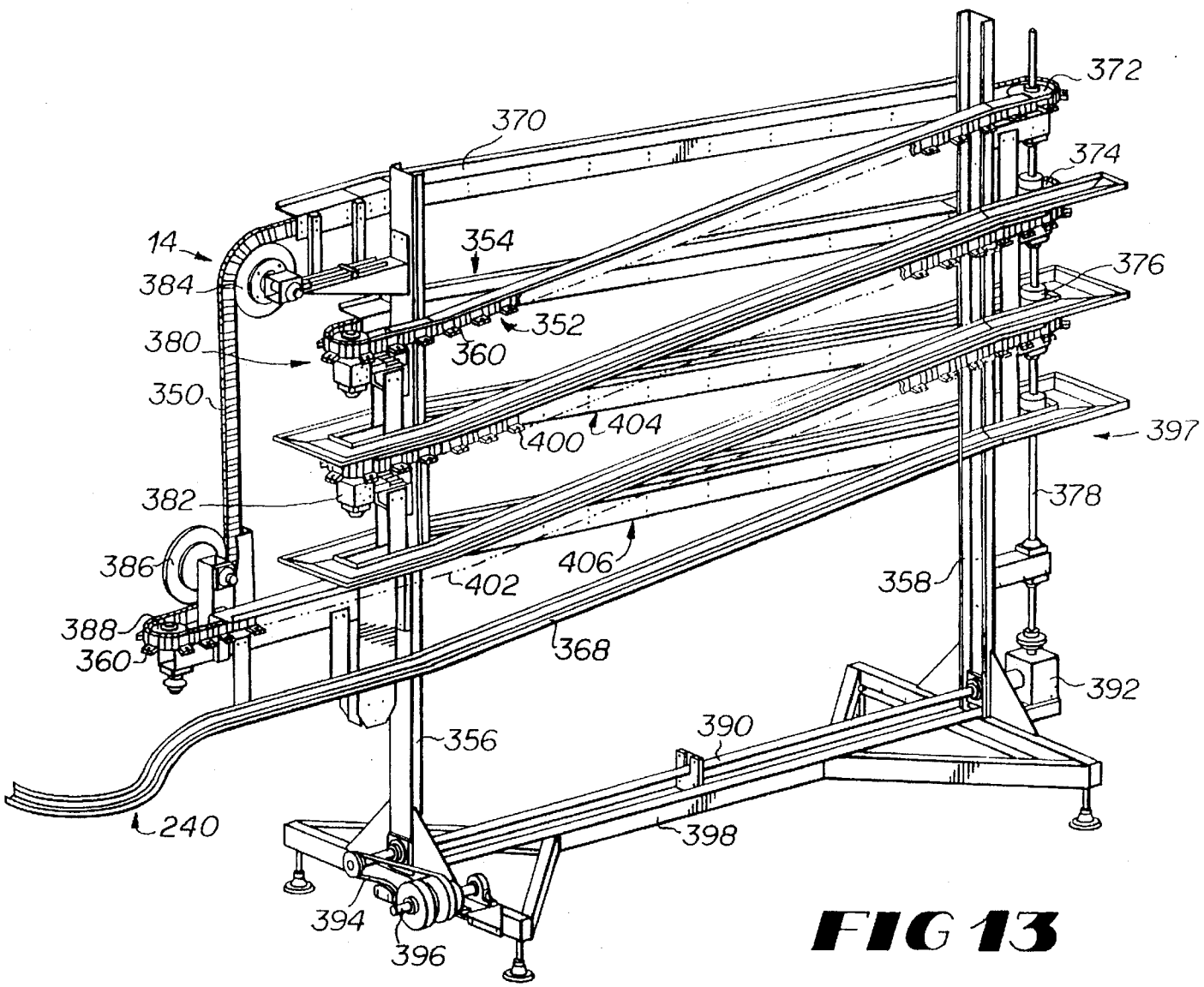
FIG. 13 is a perspective view of the conveyor of the flash-off section.

Turning to FIG. 13, a portion of the flash-off section 14 is shown. A portion of the means 240 for transferring bottles to the flash-off section is schematically indicated in this FIG. 13. The third star wheel conveyor 236 will transfer bottles to conveyor 350 of the flash-off section 14. This conveyor 350 will move bottles along a zig-zag path. The conveyor 350 is provided with a plurality of elongated rows. Front rows 352, 400, 402 and rear rows 354, 404, 406 are shown in FIG. 13. Any number of flights of rows can be used in the instant invention. The numbered front row 352 is upstream from the numbered rear row 354 in FIG. 13. The rows of conveyor 350 encircle support posts 356, 358.

The flash-off section 14 has a zig-zag configuration in order to minimize the space required. The flash-off receives bottles at a 100 bottles per minute, and allows the bottles to spend 75 seconds, for example, while the solvent, isopropyl alcohol, is evaporated as will be explained below. Because the flash-off section 14 will use as little room as possible, it can easily be added to existing production lines.

Apart from being described as having a zig-zag shape, the conveyor 350 of FIG. 9 can also be described as having an elongated spiral shape. Rows are provided on the front and rear sides of the support posts 356, 358 as noted above. In FIG. 13, the bottles are conveyed along three forward rows and two rearward rows of the conveyor 350 in the flash-off section 14. It is contemplated that the bottles will remain in the flash-off section 14 for 72–90 seconds. It is important for the bottles to stay within the flash-off section for at least a minimum of 60 seconds. Of course, this time depends upon the type of solution 200 on the exterior of the bottles 26. For example, if the solution only had a small amount of alcohol, the time needed for its evaporation would be less. The length and speed of the conveyor 350 are such that the desired amount of time for the bottles within the flash-off section 14 can be obtained.

Figure 15:
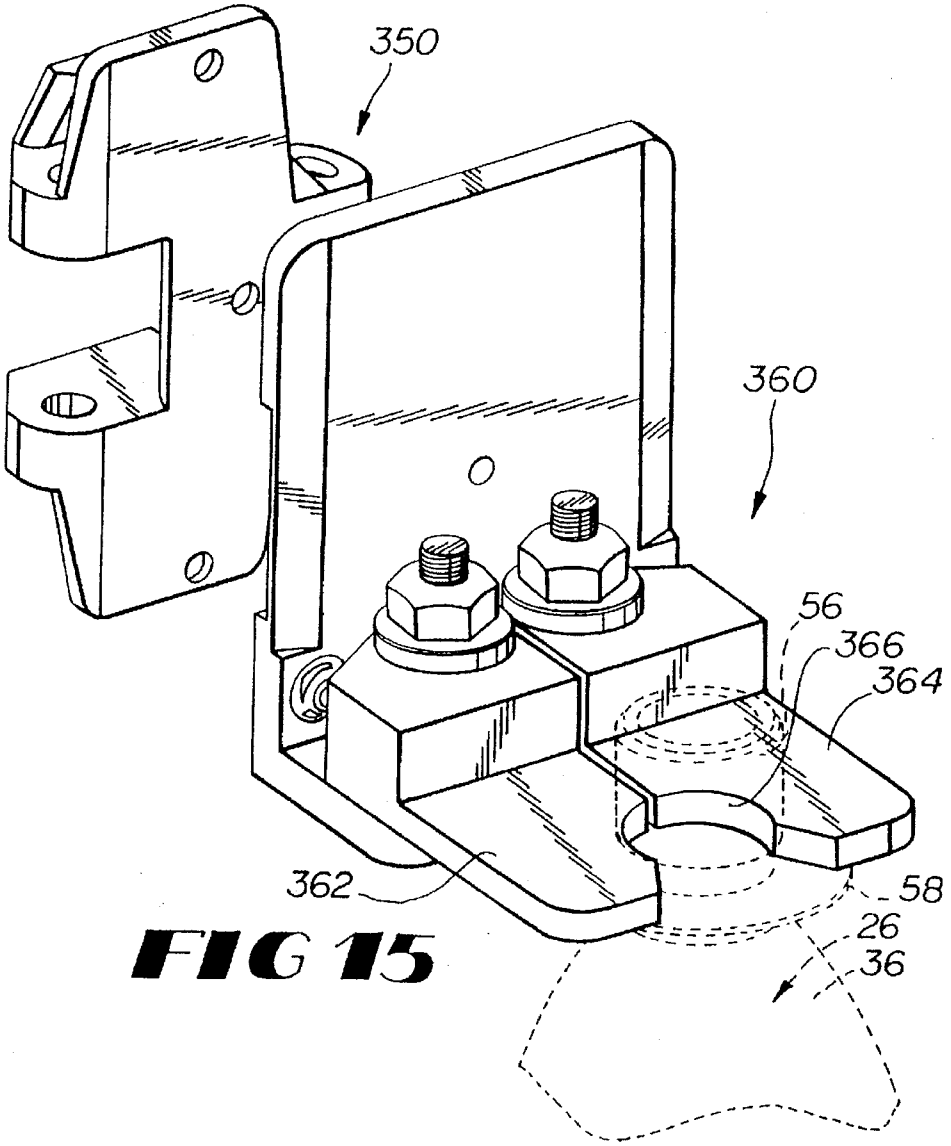
FIG. 15 is a perspective view of the spring-biased grippers used in the conveyor in the flash-off section of the present invention.

Mounted on the conveyor 350 are spring-biased grippers 360 as shown in FIG. 15. Only one link of the conveyor 350 is indicated in FIG. 15. The spring-biased grippers 360 include a left-hand portion 362 and a right-hand portion 364. These portions 362, 364 are movable toward and away from one another. They are biased to this closed position by a spring. The left-hand portion 362 and right-hand portion 364 define an opening 366 for receiving the top portion of a bottle 26. This first end of the bottle 366 is above the neck portion 36 and below the threads 56. An enlarged ring 58 is positioned adjacent to and beneath gripper portions 362, 364. It should be appreciated, however, that this enlarged ring 58 could be positioned above the top surface of the gripper portions 362, 364, if so desired.

As shown in FIG. 13, a V-shaped drip tray 368 is positioned beneath the conveyor 350. This drip tray 368 is not provided above the uppermost flight of the conveyor at 370 because bottles are not carried along this conveyor section. Rather, the bottles are discharged from conveyor 352 at the uppermost, right-hand end of the conveyor as shown in FIG. 13. This discharge arrangement will be described in detail later. A plurality of gears 372, 374, and 376 are provided at the right-hand side of the conveyor. A gear drive post 378 extends through each of these gears 372, 374, 376. One or all of the gears 372, 374, and 376 can be operatively attached to this gear drive post 378 so as to be driven thereby. It is contemplated that gears 372 and 374 will be directly attached to this gear drive post 378. Gear 376 will nonetheless be driven by the action of conveyor 350 which is driven by the remaining gears. Of course any of the selected gears could be driven.

Idler gears 380 and 382 are shown on the right-hand side of the turns of the conveyor. While a gear drive post is not shown for these gears, such a post could be provided so that either or both of these gears 380, 382 could also be driven.

A downward return gear 384 is provided at the uppermost left-hand side of the conveyor 350. This gear 384 turns the conveyor along a downward path to idler gear 386. Idler gear 386 turns the conveyor 350 to a horizontal path. Driven gear 388 is rotated about a vertical axis in order to change the course of the conveyor path 350. The drive connection for gear 388 is not shown. Any of the gears 384, 386 and 388 can be directly driven if so desired. This gear 388 will return the path of the conveyor to its initial starting position. Therefore, the conveyor 350 will run from gear 388, to gear 376, gear 382, gear 374, gear 380, gear 372, gear 384, gear 386 and back to gear 388. While a direct drive has only been shown for certain gears throughpost 378, any of the other remaining gears for the conveyor 350 could also be positively driven if so desired.

The drive post 378 is operatively connected to a horizontal drive member 390 through a gear box 392. A pulley 394 connects the horizontal drive member 390 to a drive rod 396. The drive rod 396 for the conveyor 350 is operatively connected to the drive arrangement in the coating section 12 as will be explained below. The various gears 372, 374, 376, 380, and 382, the drive gear posts 378, and the horizontal drive member 390 all act as means 397 for driving conveyor 350.

The two support posts 356, 358 are interconnected by beam 398 which underlies the horizontal drive member 390. Therefore, the support post 356 and 358 are rigidly supported in order to provide a fixed distance therebetween. The bottles gripped by conveyor 350 will travel over a path of a predetermined fixed distance. By controlling the speed at which conveyor 350 is driven, the amount of time the bottles spend in the flash-off section 14 can be controlled.

The drip tray 368 in FIG. 13 is shown as being inclined. This drip tray 360 is positioned beneath the conveyor 350. Bottles held by the spring-biased grippers 360 on the conveyor 350 will move above this drip tray 368. Any solution which drips from the bottles will be caught by the drip tray 368.

Figure 14:
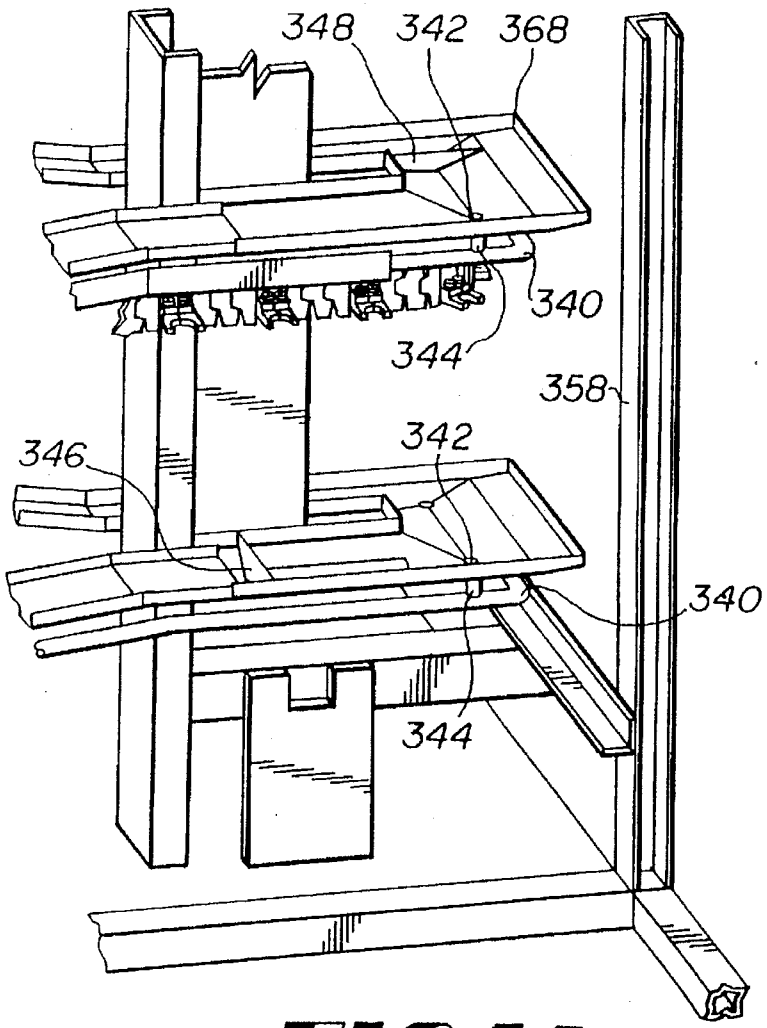
FIG. 14 is a sectional view showing a wiper and drip tray used in the flash-off section.

In FIG. 14, the V-shape for the drip tray 368 is shown. Beneath the drip tray 368 is a drain tube 340. This drain tube extends continuously beneath the continuous drip tray 368. A plurality of openings 342 are provided in the apex of the V-shaped drip tray 368. These openings 342 are connected to the drain tube 340 by spur tubes 344. While FIG. 14 only shows two spur tubes 344 and openings 342 at the turns of the drip tray, it should be appreciated that these openings 342 can be provided at any position along the length of the drip tray 368. Not only are such openings 342 contemplated at the turns of the drip tray 368, but they are also contemplated along the length of the drip tray. For each opening 342, a spur tube 344 is provided.

Solution 200 will drip from the bottles into the drip tray 368 and move towards the apex of the V-shaped tray. Because the trays are inclined throughout their paths (including the curved portions going around the support posts 356, 358), the solution will run downwardly. When the solution reaches an openings 342, it will move through spur tube 344 into the inclined drain tube 340. This continuous drain tube 340 provided beneath the drip tray 368 will continue from the bottom of the drip tray 368 to the supply line 278 to the density sensor 274 as indicated in FIG. 25 discussed above.

Provided within the drip trays 368 are wipers 346. While only one wiper 346 is shown in FIG. 14, it should be appreciated that a plurality of wipers are positioned along the length of the drip tray 368. The number of wipers 346 does not necessarily correspond to the number of openings 342. These wipers 346 can be along the length of the drip tray 368 or in the turns of this tray. These wipers 346 will engage the bottom 208 of the bottles 26 to wipe away any solution which may be clinging thereto. Therefore, drips of solution on the bottom of the bottles can be removed.

In FIG. 14, a dam 348 is also shown adjacent one of the openings 342. Any and/or all of the openings 342 in the drip tray 368 could have such dams 348. The dams 348 are on the downstream side of the openings 342. They will pool solution running down the drip trays adjacent the openings 342. Therefore, the solution 200 will not run through the drip trays at such a speed that it will not drain through the openings 342. Rather, the solution can be pooled and properly drained through the drain tube 340.

Figure 16:
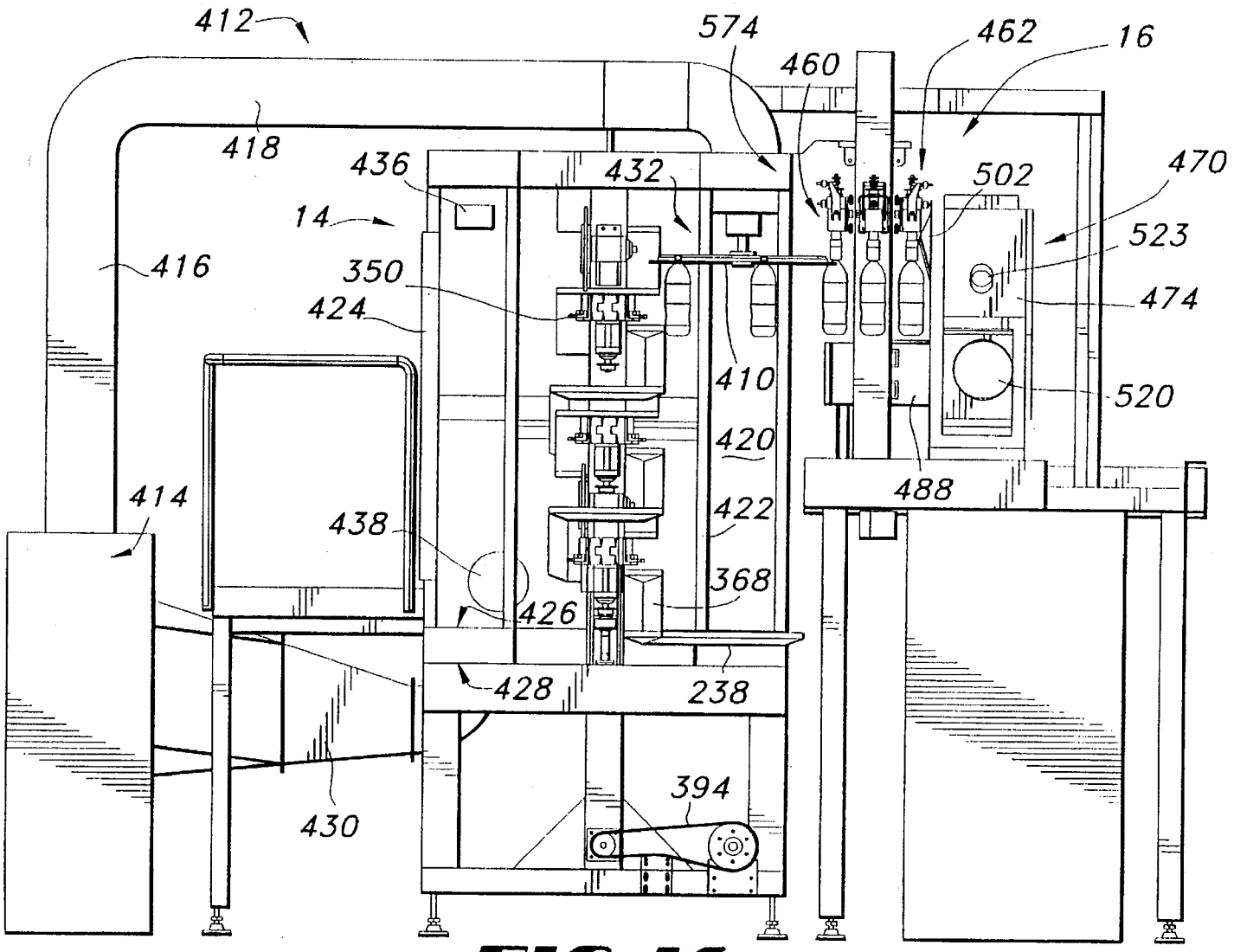
FIG. 16 is a left-side view of the flash-off section and curing section of the present invention with the side panels removed.

In FIG. 16, a left-hand side view of the conveyor 350 of the flash-off section 14 is shown. From the upper front row 352 of conveyor 350, bottles are transferred by a fourth star wheel conveyor 410 to the curing section 16. An opening 423 (exit) in the housing of the flash-off section 14 is provided adjacent this fourth star wheel conveyor 410. Also, adjacent the means 240 for transferring bottles from the coating section 12 to the flash-off section 14, another opening 434 (entrance) is provided. Doors can be provided at either side of the flash-off section if so desired. However, apart from the openings at the four star wheel conveyor 410 and the means 240 for transferring, no other openings are provided during operation of conveyor 350. Therefore, the flash-off section 14 will be air-tightly sealed during operation.

Means 412 for removing solvent such as alcohol from the exterior of the bottles 26 is provided. This means 412 includes fan 414. The fan 414 has an upwardly extending duct 416 connected to a horizontally extending duct 418. The duct 418 goes to the front upper side of the flash-off section 14. This duct 418 will introduce air to a chamber 420 along the front side of the flash-off section 14. The air will then move through baffles 422 on the rear side of chamber 420. The air will pass horizontally across the conveyor 350 and the bottles held thereon. This air will impinge on the rear wall 424 of the flash-off section 14. This rear wall 424 can have sealed doors or other openings therein to provide access to the flash-off section 14.

When the air hits the rear wall 424, it will drop downwardly through a grate 426 provided in the bottom of the flash-off section 14. An opening at 428 is provided beneath grate 426 in the bottom of the flash-off section 14. This opening 428 will lead to horizontal return duct 430. The horizontal return duct 430 is fluidly connected to the fan 414. Upon operation of the fan 414, air will be blown through ducts 416 and 418 into chamber 420. Air will then move horizontally from the first side of the flash-off section 14 across the bottles 26 and conveyor 350 and impinge on the wall 424 at the second side of the flash-off section. The air will then drop downwardly through the grate 426 and opening 428 and return through horizontal duct 430 to fan 414. In this manner, air can be circulated in the flash-off section 14.

It is contemplated that twelve thousand (12,000) cubic feet per minute of highly treated air will be blown through the flash-off section 14. As noted above, the bottles 26 will be on conveyor 350 in the flash-off section 14 such that they can be treated by air for a minimum of 60 seconds and preferably 72–90 seconds and even more preferably for 75 seconds. This amount of time, however, depends on the type of solution that has been removed from the bottle exterior. This air flow will evaporate alcohol solvent from the solution 200 on the bottles 26. Therefore, when the bottles 26 exit the flash-off chamber 14 through exit 432, resin will remain on their exterior.

As noted above, the flash-off section 14 is air-tightly sealed except for the bottle exit 432 and the bottle entrance 434. Therefore, ambient air is prevented from entering this flash-off section 14. As will be described below, the air within the flash-off section 14 is highly treated. Therefore, possible contamination or marring of the bottles by impurities in the air in the flash-off section will be prevented. Also, removal of alcohol and proper coating of the bottles with resin is insured in this flash-off section 14.

While the air in the flash-off section 14 is circulated by the means 412 for removing solvent, the alcohol content of the air will increase. A sensor 436 is schematically indicated in FIG. 16. This sensor acts as means 436 for detecting alcohol content of the air. When the level of alcohol in the air in the flash-off section is detected to be above a predetermined limit, means 450 for withdrawing alcohol-laden air will be activated. This means 450 will be described in more detail below. This means 450 is connected to the flash-off section through an opening 438 as seen in FIG. 16. Alcohol-laden air will be withdrawn through this opening 438 by the means 450 for withdrawing as will be described in detail below.

Curing Section

From the flash-off section 14, the bottles are transferred to the curing section 16 by the fourth star wheel conveyor 410. This conveyor 410 places the bottles adjacent curing chucks 460. These chucks 460 are mounted on a conveyor 462 in the curing section 16.

Figure 17:
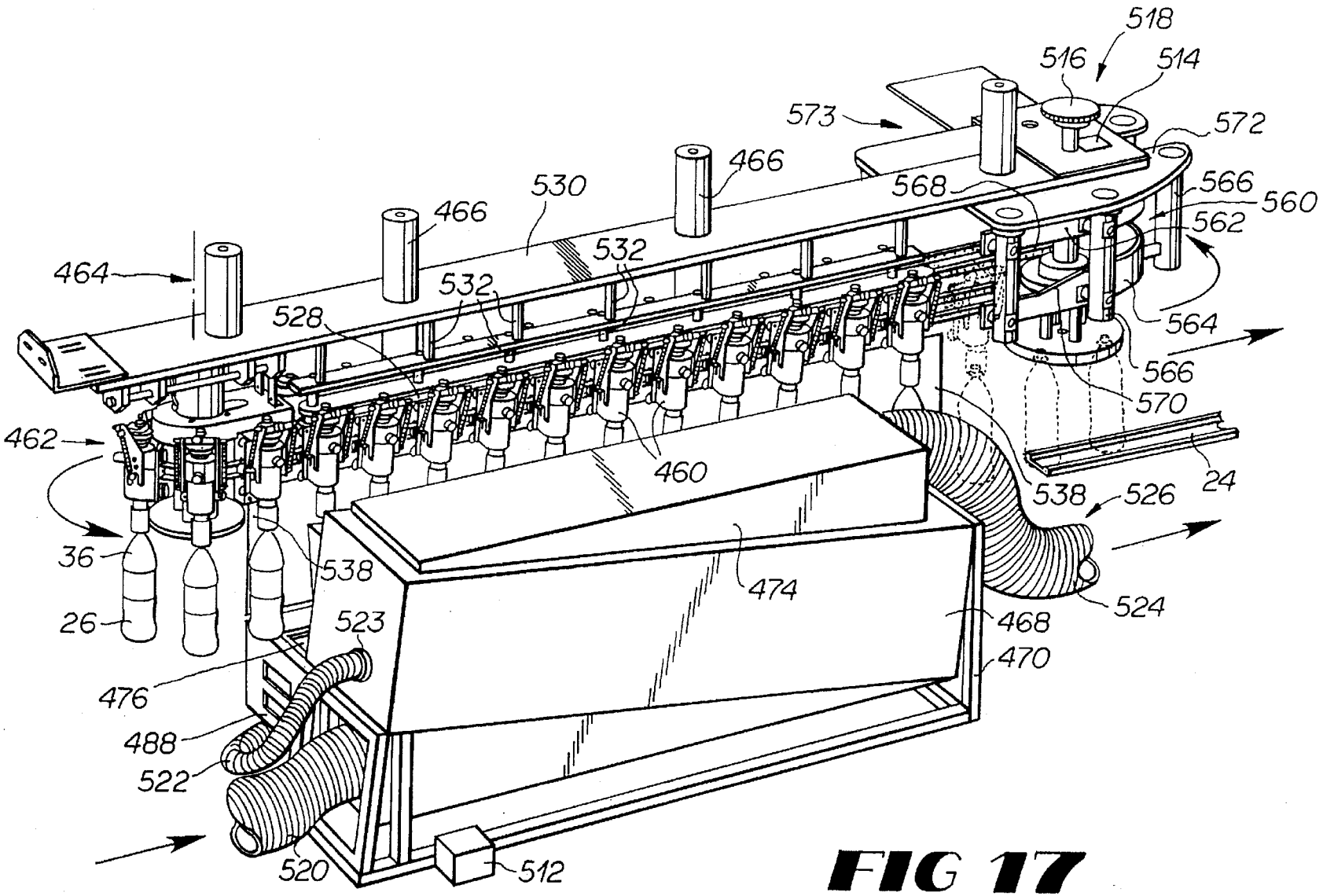
FIG. 17 is a perspective view showing the conveyor and rear of a plurality of ultraviolet lights in the curing section of the present invention.

As seen in FIG. 17, the conveyor 462 moves in a counterclockwise direction. Bottles are received on the chucks 460 of the conveyor 462 at the rear right-hand side of FIG. 17. These bottles will be conveyed along a rear path of the conveyor 462 which is not seen in FIG. 17. The conveyor 462 turns around a gear rotating about vertical axis 464. The bottles will be conveyed about this turn and then move along the forward path of the conveyor 460. Supports 466 hold the conveyor 462 within the curing section 16. These supports 466 can be mounted to the roof of the curing section, for example.

Figure 18:
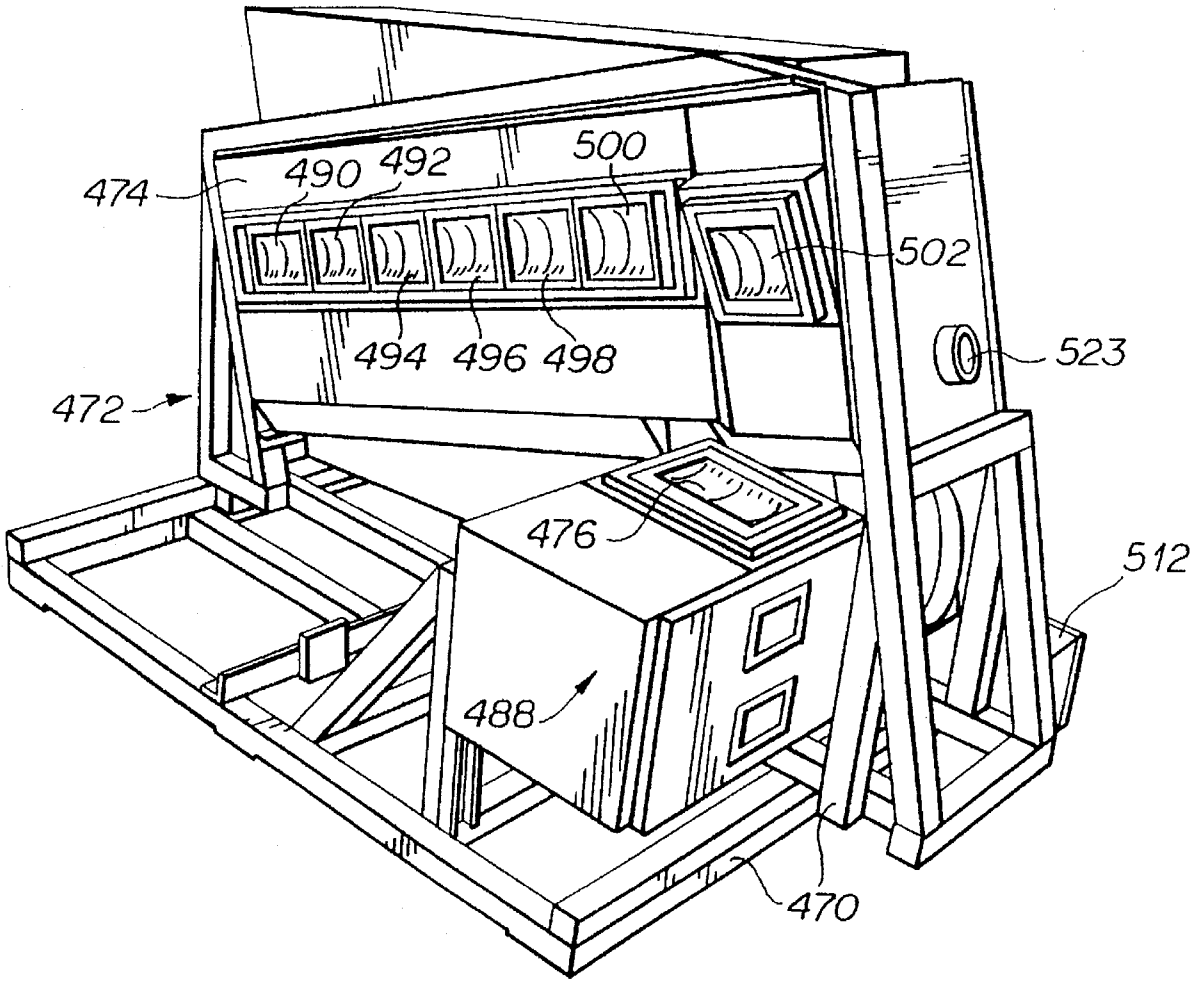
FIG. 18 is a front perspective view of the ultraviolet lights of the curing section of the present invention.

The conveyor 460 will move the bottles 26 past means 468 for curing resin on the exterior of the bottles. While it has been set forth that a solution of resin and alcohol is initially applied to the bottles and then this alcohol is removed, any suitable solution can be applied to the bottles. Therefore, whatever coating is desired to be cured on the bottles can be done so as they move past this means 468. The means 468 is mounted on support 470 as indicated in FIGS. 17 and 18. This means 468 for curing includes a plurality of ultraviolet lights 472. The ultraviolet lights include a plurality of vertically oriented lights mounted in a vertical light housing 474. This housing 474 is mounted on support 470. Also, one horizontal light 476 is shown in FIG. 18. This horizontal light 478 is mounted in horizontal light housing 488 which is also mounted on support 470. Therefore, this support 470 supports both the horizontally oriented and vertically oriented lights. The vertically oriented lights include six vertically oriented lights 490, 492, 494, 496, 498, and 500. Also, an inclined or slanted vertical light 502 is mounted in the vertical light housing 474.

In FIG. 17, only the rear of the vertical light housing 474 and a portion of the horizontal light 476 are shown. It should be appreciated, however, that the bottles 26 on the conveyor 462 are moved past each of these lights 476, 502, 500, 409, 496, 494, 492, and 490.

The horizontally positioned light 476 is positioned beneath the bottles 26 on conveyor 462. Ultraviolet light from light 476 will cure resin on the bottoms of the bottles 26. Ultraviolet light from the inclined light 502 will cure resin on the neck portion 36 of the bottles. The remaining lights 500, 498, 496, 494, 492, and 490 will primarily cure resin on the sides of the bottles 26. The slope or incline of light 502 generally matches the slope or incline of the neck portion 36 of bottles 26. The ultraviolet bulbs of the ultraviolet lights have lenses which will focus the ultraviolet energy to properly cure the bottles.

The conveyor 462 moves bottles past the ultraviolet lights 472. This conveyor 462 is rotated at 200 rpm to insure proper coating of the bottles and to conserve energy by fully utilizing the ultraviolet bulbs. Two seconds of cure for each bottle in front of the ultraviolet lights are contemplated. Because a plurality of ultraviolet lights 472 are provided add due to the spacing of the bottles on conveyor 462, plurality of bottles will simultaneously be in front of the means 468 for curing.

The ultraviolet lights 472 are 40 KWH—kilowatts per hour. Of course, any suitable curing source can be used. There is an individual power supply generically indicated at 504 in FIG. 1 for each of the ultraviolet lights. Also, an air-intake tubing 506 is shown in FIG. 1. Air will be infed from beneath the curing section 16 through the air-intake tubing 506 into section 16. Suitable filters and/or drive fans, if necessary, can be provided beneath the curing section 16 operatively connected to the air-intake tubing 506.

A door 508 and ladder 510 are shown in FIG. 1 for the curing section 16. This curing section 16 is elevated because the conveyor 350 of the flash-off section 14 feeds bottles at an elevated position particular, bottles are infed to the conveyor 350 of the flash-off section 14 at a lower position, then moved upwardly about various flights and discharged from an upper side of section 14. Therefore, the fourth star wheel conveyor 410 transfers the bottles to the curing section 16 at an elevated position. It should be appreciated, however, that these bottles can be lowered by a suitable conveyor such that the curing section 16 does not need to be elevated. If this were the case, the ultraviolet light power supply 504 and the air-intake tubing 506 could be arranged in a different position.

The door 508 for the curing section 16 is opened in FIG. 1. This door of course will be closed such that the curing section 16 is sealed during operation. A portion of the rear of the means 468 for curing is also shown in FIG. 1 through door 508.

Mounted beneath the curing section 16 or in any other suitable location are two stepper motors. These motors are connected to adjustment means 512 for support 470 as schematically indicated in FIG. 18. This adjustment means 512 can vertically and horizontally move support 470. Instead of a single adjustment means 512 as schematically shown in FIG. 18, two different adjustment means can be provided. One of these adjustment means would vertically move the support 470 while the other would horizontally move the support 470.

The support 470 can be mounted on tracks or rollers so it can move horizontally through adjustment means 512. Screws or a pulley arrangement or a sprocket-and-gear arrangement can also be used for horizontally moving the support 470. A similar arrangement can also be used by the means 512 for vertically moving the support 470.

As seen in FIG. 17, it should be appreciated that when adjustment means 512 vertically moves support 470, the horizontal light 476 will move toward or away from the bottles 26 and conveyor 462. This adjustment can be done in order to accommodate different sized bottles on conveyor 462.

Also, the horizontal movement of the support 470 by the adjustment means 512 will move the vertically oriented and inclined ultraviolet lights toward and away from the bottles 26 on the conveyor 462.

The control means 18 can be used for operating this means 512. A sensor 514 can be mounted adjacent gear 516 for detecting speed of this gear. The gear 516 is part of the means 518 for driving conveyor 462. This sensor 514 will detect the speed of the conveyor 462. Any other suitable sensor arrangement could be used. Upon detecting an increased speed of the conveyor 462, the sensor 514 will send a signal to the control 18. This control 18 will then cause the adjustment means 512 to move the support 470 closer to the conveyor 462. On the other hand, when sensor 514 detects a slower speed for the conveyor 462, the control 18 can move the support 470 further from the conveyor. Therefore, the vertical lights 490, 492, 494, 496, 495 and 500, and the inclined light 502 will move toward and away from the bottles 26 held by conveyor 462 in response to the speed of the conveyor.

This movement will help to insure proper curing of resin on the bottles. When the speed of the conveyor 462 increases, the lights on support 470 move closer to the bottles 26 in order to better cure the resin. In order to avoid overheating of the bottles, when the conveyor 462 moves at a slower speed, the ultraviolet lights on support 470 will horizontally move away from the conveyor. Therefore, proper curing of the lights and control of excess heat on the bottles 26 can be obtained.

The means 512 for adjusting the support 470 can be a stepper motor. This means 512 will insure that the focal distance is always correctly proportional to the speed of the bottles on conveyor 462. The faster the bottles travel, the closer the lamps.

As seen in FIG. 17, an air-infeed duct 520 is provided for the vertical light housing 474. This air-infeed duct 520 is connected to the air-intake tubing 506 shown in FIG. 1. The horizontal light housing 488 has an air outfeed duct 522 connected to the vertical light housing 474. An air outfeed duct 524 is connected to the opposite side of the vertical light housing 474. Air will be drawn through this vertical light housing 474 and also from the horizontal light housing 488 and discharged through air outfeed duct 524 as will be explained below with regard to the air handling system of the present invention. This air outfeed duct 524 is part of the means 526 for withdrawing air from the curing section.

A connection 523 is provided for the outfeed duct 522 to the vertical light housing 474. While an air outtake 522 is shown for the horizontal light housing 488, it should be appreciated that the opposite side of the horizontal light housing 488 can have an opening such that a vacuum will not be formed when air is withdrawn therefrom.

Figure 20:
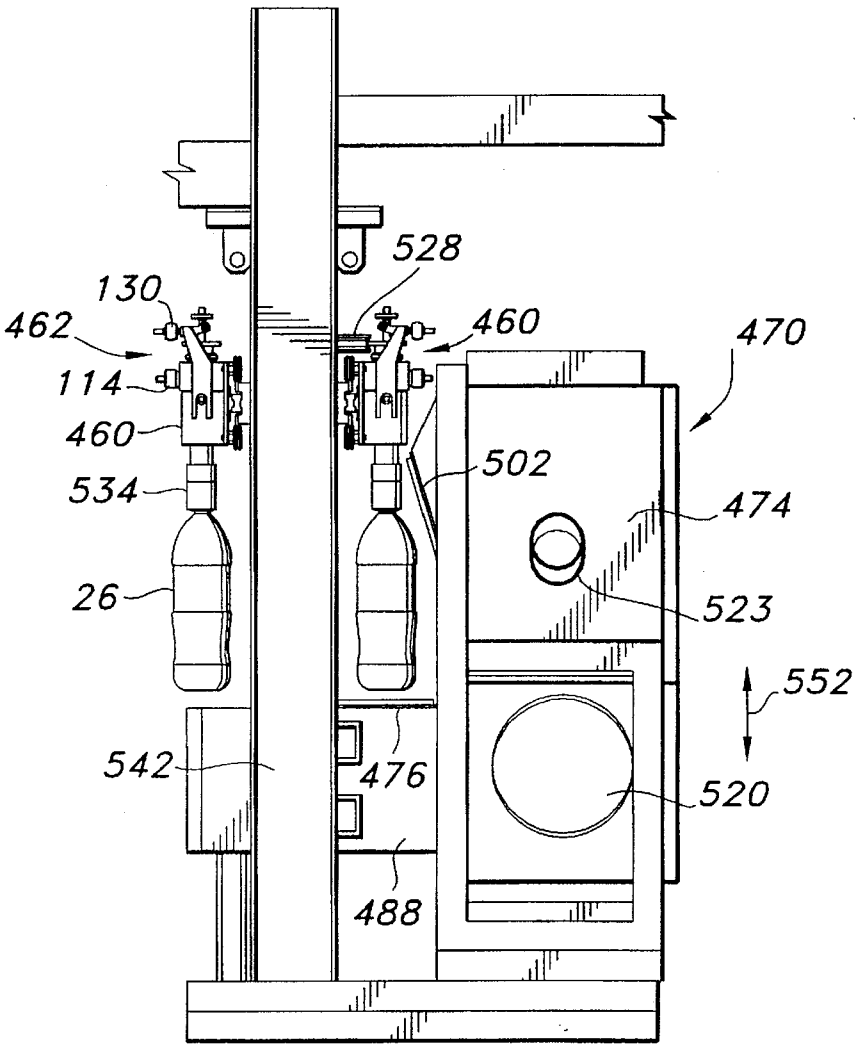
FIG. 20 is a left-side view of the light assembly and a cross-section of the conveyor of the curing system of the present invention.
Figure 21:
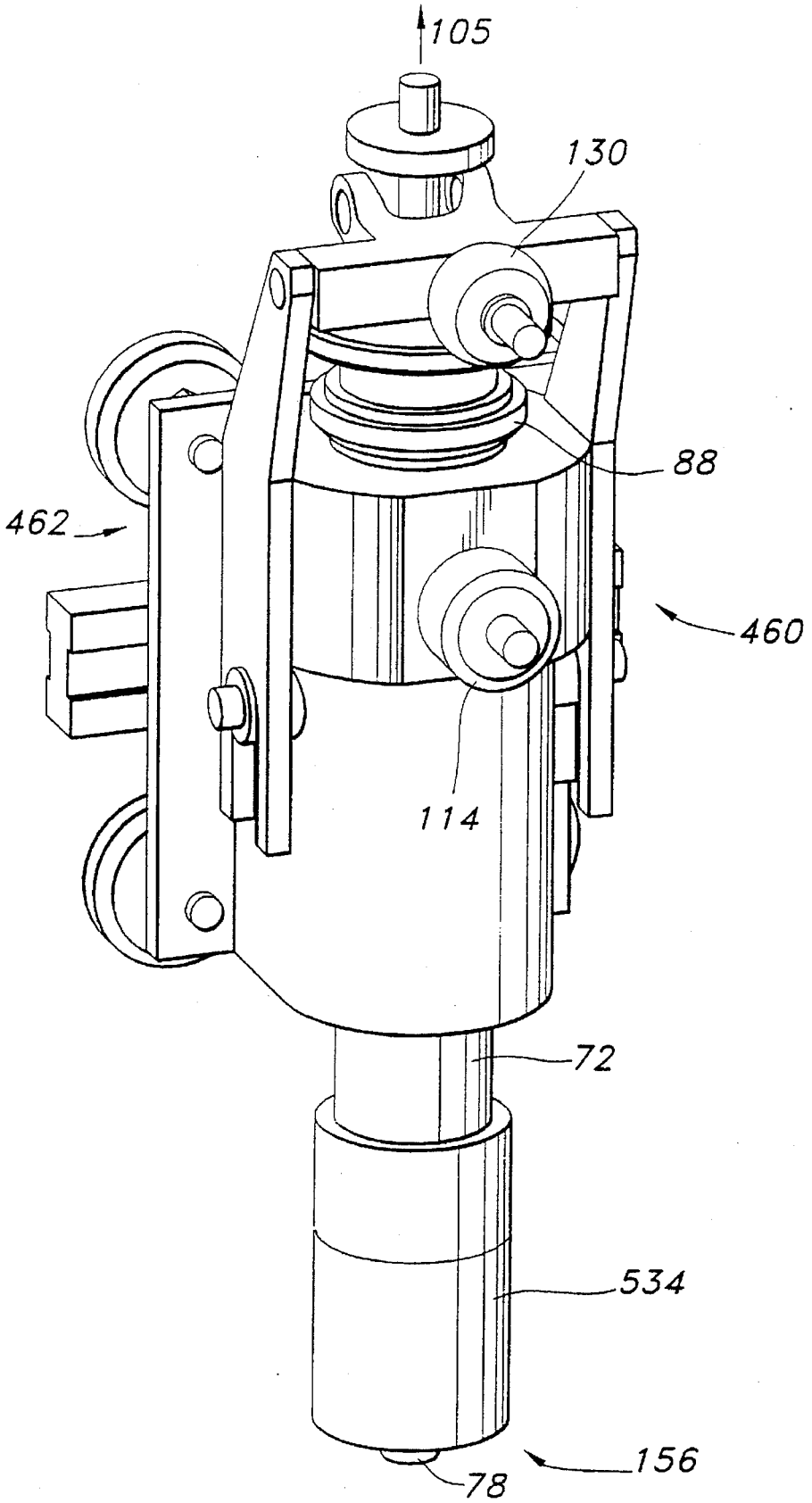
FIG. 21 is a perspective view of a chuck used on the conveyor in the curing section of the present invention.

The conveyor 462 in FIG. 17 moves past a frictional surface 528. The frictional surface 528 is mounted to the horizontal upper support 530 of conveyor 462 through a plurality of vertical posts 532. As seen in FIGS. 20 and 21, friction wheel 88 of curing chucks 460 will engage this frictional surface 528. Upon engagement of the friction wheel 88 with the frictional surface 528, the chucks will be rotated about their longitudinal axis 105.

Basically, the chucks 460 seen in FIG. 21 are the same as the chuck 40 shown in FIGS. 7 and 8. The mounting of this chuck 460, however, on conveyor 462 is slightly different. Therefore, this chuck 460 has been given a different reference numeral. Also, the thread shield 534 on the chucks 460 is slightly larger than shield 80 on chucks 40. This shield helps to hold the bottles 26 securely in the chucks 460. Similarly to the previously described chuck 40, the chuck 460 has upper cam 130 and lower cam 114. These cams will engage a cam track as will be described below.

In the foregoing description of chuck 40, the spindle 72 was described as being rotatable about the longitudinal axis 105. It should therefore be appreciated that when the friction wheel 88 of the chuck 460 engages the frictional surface 528, spindle 72 of chuck 460 can similarly rotate about longitudinal axis 105 in order to rotate the thread shield 534 and the interiorly positioned expansion portion 78. Therefore, as indicated by the arrows in FIG. 22, the bottles can be rotated about their longitudinal axes 536 as they pass in front of the ultraviolet lights 472.

Figure 22:
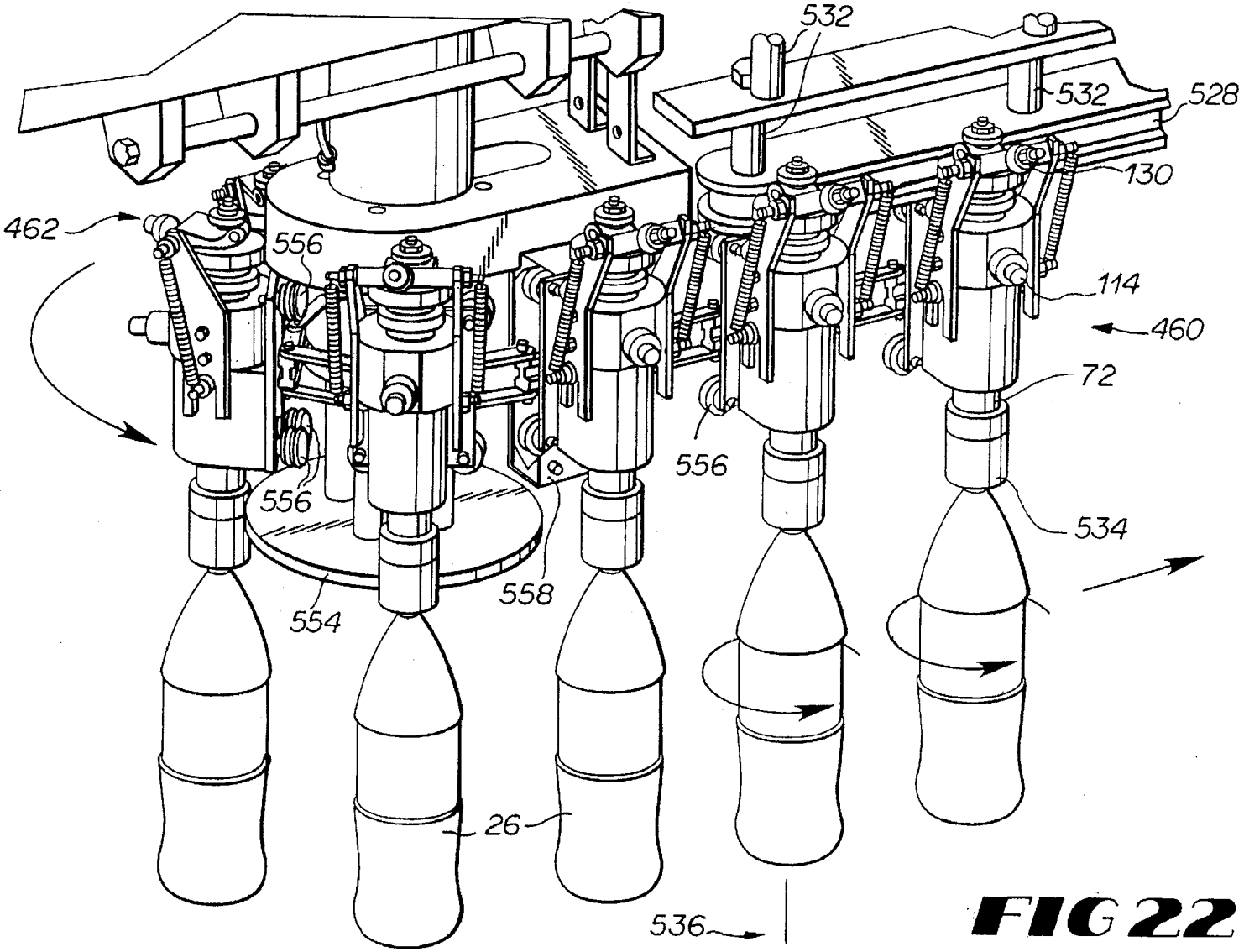
FIG. 22 is a perspective view of an end of the conveyor showing the rotating chucks in the curing section of the present invention.

In FIG. 22, a circular guide 554 engages the thread shield 534 of the curing chucks 460. This guide 554 helps to steady the chucks and bottles as the conveyor turns. Guide wheels 556 are provided at four corners adjacent each of the chucks 460 on conveyor 462. After turning the corner at the first end of the conveyor 462, these wheels 556 will enter a guide 558. While the two lower wheels 556 are only temporarily in this guide, the upper wheels remain in guide 558 along the length of the frictional surface 528. Of course, both the upper and lower wheels could be guided along the entire length of the frictional surface if so desired. This guide 558 helps to steady the chucks 460 as they are rotated about the longitudinal axis 536 of the bottles 26.

As seen in FIG. 17, the frictional surface 528 only extends along a portion of the conveyor 462. Basically, this frictional surface 528 only extends in front of the ultraviolet lights 472 such that the bottles are only rotated about their longitudinal axis 536 in this area. For the remainder of the conveying both upstream of the ultraviolet lights 472 and downstream of the ultraviolet lights 472, the bottles are not rotated about their longitudinal axis 536 when they are held by the curing chucks 460 of the conveyor 462 in the curing section 16. In other words, after the curing chucks 460 move past the lights 472, the friction wheel 88 will disengage from the frictional surface 528. Rotation of the curing chucks 460 and the bottles held thereby will therefore stop.

Extending for approximately the same length as the frictional surface 528 is a quartz shield 538. Air flow through the curing section 16 and this quartz shield 538 help to protect bottles 26 from extreme heat. In addition, the bottles will rotate at 200 rpm during rotation of the curing chucks 460 as they move along the frictional surface 528. This rotation will also help to insure proper curing of the bottles and protect the bottles from extreme heat. The rotation will also conserve energy by fully utilizing the ultraviolet lights 472. Sensors can be provided to insure proper exposure to the light and to control the excess heat.

While the quartz shield 538 is hidden in FIG. 20 by support beam 542, the frictional surface 528 is shown. An upper support beam 544 in FIG. 19 hides both the frictional surface 528 and the quartz shield 538. Nonetheless, it should be appreciated that these members extend for approximately the distance indicated by arrow 546. Therefore, their length is approximately equal to the length of the vertical light housing 474.

Figure 19:
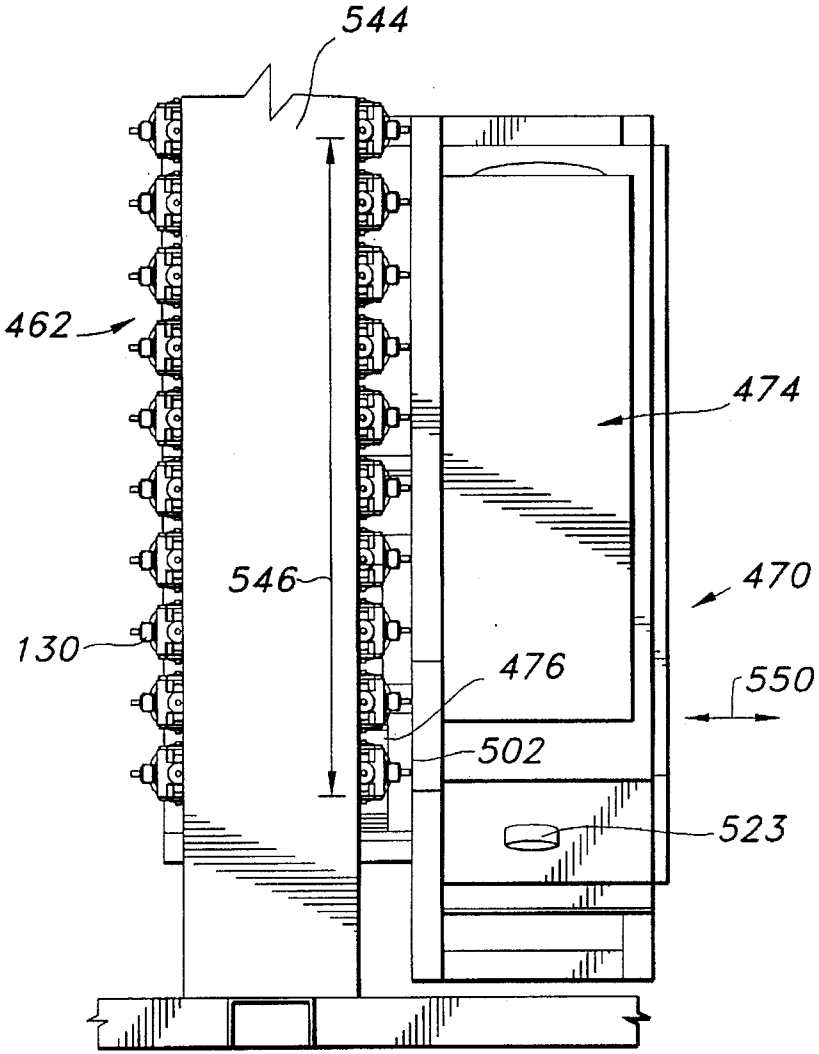
FIG. 19 is a top view of the conveyor and ultraviolet lights of the curing section of the present invention.

In FIGS. 19 and 20, the horizontal movement and the vertical movement of the support 470 is indicated by arrows 550, 552, respectively. As previously noted, adjustment means 512 will horizontally move the support as indicated by arrow 550 toward and away from the conveyor 462. This movement is done in response to the speed of the conveyor. Also, the means 512 for adjusting will vertically move the support 470 as indicated by arrow 552 in FIG. 20. This movement can accommodate different heights of bottles 26 on the conveyor. These horizontal and vertical movements by the adjustment means 512 can be simultaneously carried out or can be sequentially carried out.

It is contemplated that during a production run, the vertical height will not be repeatedly adjusted by the means for adjusting 512. As long as the size of the bottles remains the same, this vertical adjustment is unnecessary. However, due to changes in throughput of the system, the speed of the conveyor 462 is likely to frequently change during a production run. Therefore, the means 512 will frequently adjust the horizontal spacing of the support 470 as indicated by arrow 550.

After the conveyor 462 moves bottles 26 past the ultraviolet lights 472, the bottles are released from the chucks 460 onto the bottle discharge conveyor 24. This operation will now be described with reference to FIGS. 17 and 23. At the second end of the conveyor 460 are a pair of cam tracks 560. These cam tracks 560 comprise an upper cam track 562 and a lower cam track 564. Supports 566 rigidly hold the cam tracks 560. Therefore, the distance between the cam tracks 560 is constant. The supports 566 are mounted to plate 572 which is rigidly mounted on upper support 530.

The upper cam track 562 has a camming surface 568 while the lower cam track 564 has a camming surface 570. The cams 130 and 114 of the curing chucks 460 will engage the cam surfaces. In particular, the lower cam 114 will move along camming surface 570 while the upper cam 130 will move along the upper camming surface 568.

Before the curing chucks 460 reach the cam tracks 560, the upper and lower cams 130, 114 of the chuck are forced away from one another by compression spring 140. This compression spring 140 was described in FIG. 7 when discussing the chucks 40 in the coating section 12. As previously noted, the curing chucks 460 in the curing section 16 have a similar structure to those chucks 40. This structure includes the compression spring 140 and the other internal structure of the chuck.

When the cams 130, 114 are forced away from one another, the expansion portion 78 of the curing chuck 460 will engage the interior of the bottles 26. The bottles will be held between the thread shield 534 and the expansion portion 78. Therefore, the pair of cams 114, 130 and the expansion portion 78 act as means 156 for engaging the interior of the bottles.

When the curing chucks 460 on conveyor 462 reach the cam tracks 560, the upper cam 130 will engage camming surface 568. The lower cam 114 on the curing chuck 460 will engage the camming surface 570. As conveyor 462 continues to rotate, the camming surface 570 approaches the camming surface 568. This will cause the cams 130, 114 to move toward one another and thereby release the expansion portion 78 from the interior of the bottles. The bottles will then be discharged onto conveyor 24. Continued movement of the conveyor 460 causes a lifting of the chucks as they move forwardly, as seen in FIGS. 17 and 23. This will insure that the thread shield 534 is out of the way of the bottles. The bottles will be accurately placed on discharge conveyor 24 without being tipped over by engagement with the cams 462. The rotation of the conveyor 462 will cause the chucks to continue to follow the cam tracks 560.

Figure 23:
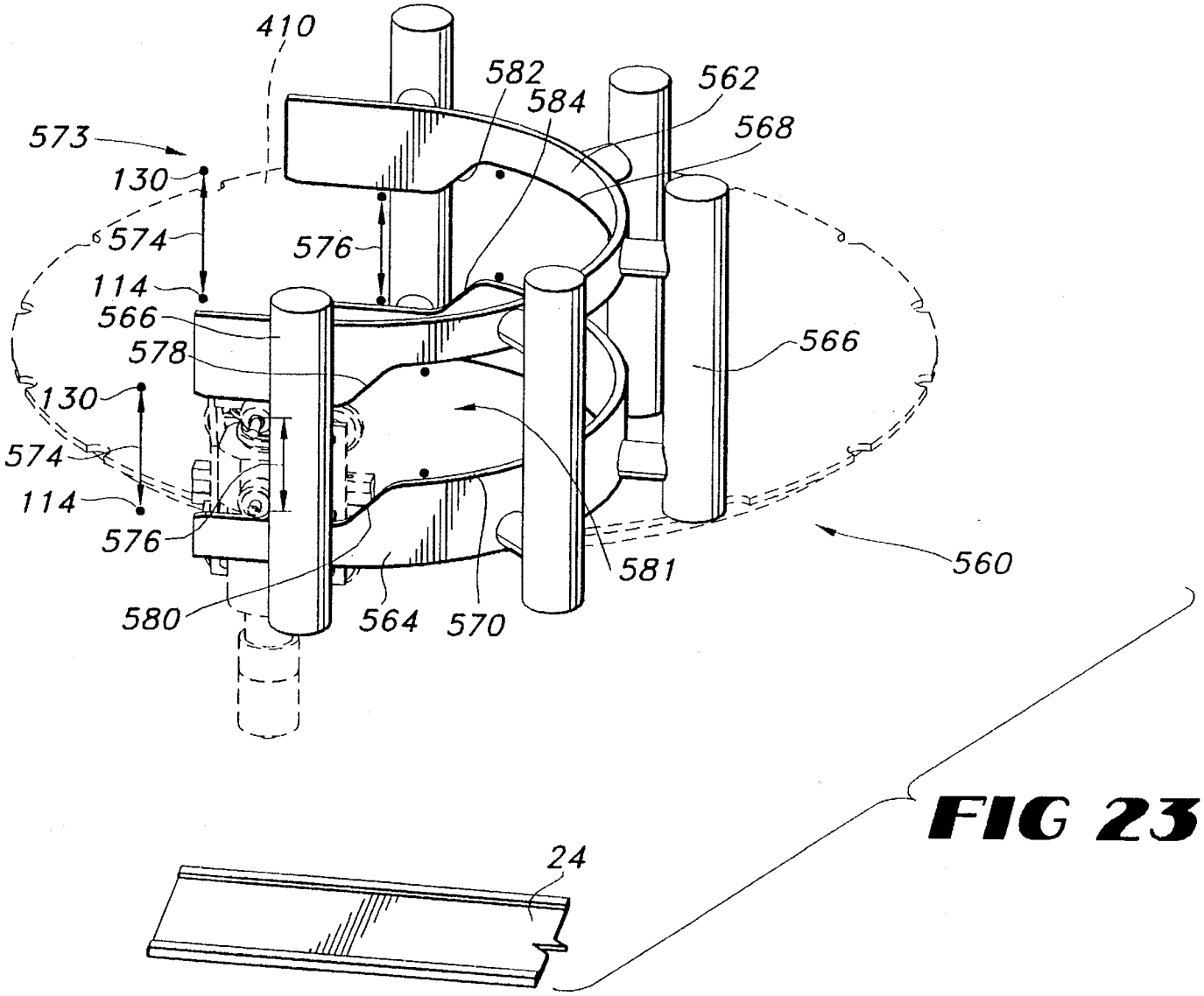
FIG. 23 is a schematic view of the cam tracks in the curing section.

As these chucks 460 reach the rear of the conveyor as seen in FIGS. 17 and 23, they will approach an infeed area 573. Here, bottles will be fed by the fourth star wheel conveyor 410 from the flash-off section 14 to the curing section 16. When the bottles are infed, the chucks will simultaneously be lowered so that the thread shield 534 will surround the threads of the bottle. Then, camming surfaces 568, 570 will move away from one another in order to cause the expansion portion 78 to engage the interior of the bottle. The bottles will then firmly be held by curing chucks 460 as they rotate with curing conveyor 462.

In FIG. 23, the cams 130, 114 are merely schematically shown. It can be seen that the cams 130 are at a first distance 574 before they enter the cam tracks 560. This is the maximum separation distance wherein the expansion portion 78 securely engages the interior of the bottles. When the cams move into the cam tracks 560, they are moved toward one another such that there is a second distance 576 therebetween. In this position, the expansion portion 78 will be released from the interior of the bottles.

Upon continued rotation of the conveyor 462, the cams will be elevated as they move along inclined portions 578, 580 of the upper and lower cam tracks 562, 564, respectively. In the position indicated schematically at 581, the cams are elevated. Therefore, the thread shield 534 will be positioned away from the bottles to avoid interference with discharge of the bottles 26 on conveyor 24.

The cams 130, 114 will continue to rotate about the cam tracks 560 due to the rotation of the conveyor 462. Downwardly sloped portions 582, 584 are provided on upper and lower cam tracks 562, 564, respectively. These portions will lower the cams. In this position, the fourth star wheel conveyor 410 will infeed bottles 26 from the flash-off section 14. As the cams 130, 114 are lowered, the curing chucks 460 will be lowered onto the bottles such that the threads 534 enclose the outer surface of the bottles about their upper opening. Then, the cams 130, 114 exit the cam tracks 560. As noted above, the compression spring 140 forces these cams 130, 114 away from one another such that the cams move from the second distance 576 back to the first distance 574. In this position, the expansion portion 78 will be expanded in order to securely hold the interior of the bottles. Therefore, the bottles will be held by means 156 for engaging the interior of the bottles.

It should be appreciated that the spacing between adjacent chucks 460 in FIG. 23 is not accurately shown. Rather, these chucks would be evenly spaced. However, the schematic showing for the spacing is merely to indicate the various movements of the cams 130, 114 as they rotate around the cam tracks 560.

The discharge conveyor 24 is shown in FIG. 23. This conveyor 24 starts before the chucks 460 reach the cam tracks 560. The speed of the discharge conveyor 24 and the conveyor 462 in the curing section 16 will be the same. Therefore, bottles will temporarily be held by both the chucks 460 on conveyor 462 and by the discharge conveyor 24. However, as the chucks move over inclined portions 578, 580, they will completely release the bottles which are then only supported by the discharge conveyor 24. A small discharge conveyor 24 can be provided which is only in the area adjacent the cam tracks 560. This conveyor can then move to a separate downstream discharge conveyor (not shown) which would move the bottles at the same or a different speed from the first conveyor 24. Alternatively, an extended conveyor 24 can be positioned adjacent the cam tracks 560 and can remove the bottles from the curing section 16. The drive arrangement for the conveyor 462 will be described in detail below.

Air Handling System

Figure 24:
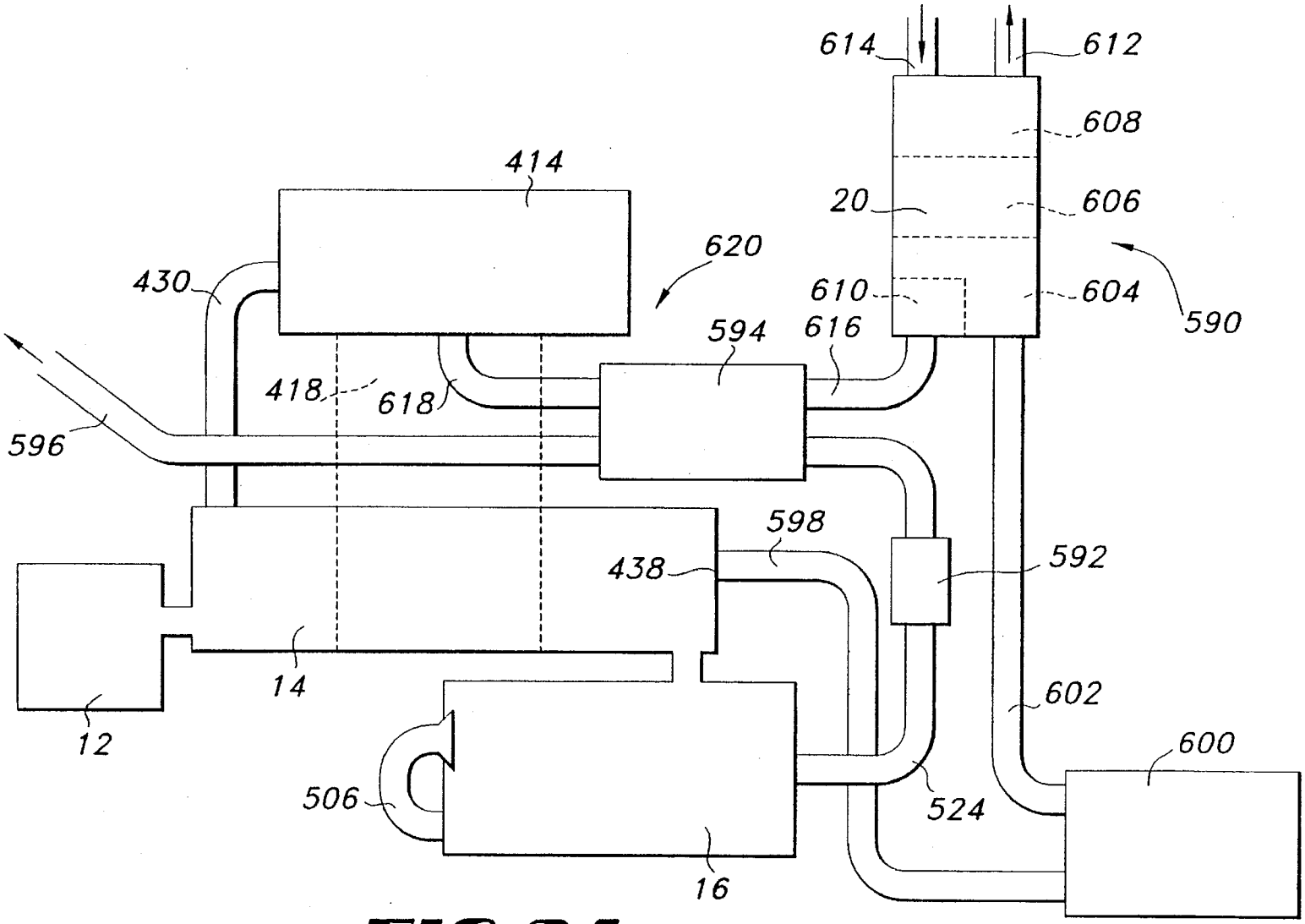
FIG. 24 is a schematic view showing the air flows between the various sections of the present invention.

Turning now to FIGS. 1 and 24, the air handling system 590 of the present invention will be described. In FIG. 24, the coating section 12, flash-off section 14, and curing section 16 are schematically shown. As previously discussed, an air-intake tubing 506 is provided for the curing section 16. The intake for this tubing 506 and/or a fan can be located beneath the housing for the curing section 16. The air-intake tubing 506 is connected to the air-intake duct 520 of the vertical light housing 474 in the curing section 16. Air is fed out from this vertical housing 474 through air-outfeed duct 524. Instead of being provided in the air-intake tubing 506 or in addition to this air-intake tubing fan, a fan 592 can be provided in the air-outfeed duct 524. Air heated by the ultraviolet lights 472 in the curing section 16 is fed through duct 524 to a heat exchanger 594. This air is then discharged to the ambient environment through duct 596. The air travelling through duct 524 has been heated by the ultraviolet lights in the curing section 16. At the heat exchanger 594, this air will lose some of its heat as will be explained in detail below.

Accordingly, a first air flow to the curing section 16 involves intake of air through air-intake tubing 506, flow of air through the air-infeed duct 520, the vertical light housing 474, the outfeed duct 524, the heat exchanger 594 to the discharge duct 596.

A second air flow in the instant invention is provided from flash-off section 14. An opening 438 in the flash-off section is connected to duct 598. This duct 598 leads to incinerator 600. The air which is withdrawn from the flash-off section 14 is alcohol-laden air. The alcohol in this air will be burnt off by incinerator 600. Some of this air will be vented to the ambient environment while a portion of the heated air will flow through duct 602 to the air make-up system 20.

The incinerator 600 will collect and burn solvents including alcohol from the flash-off section 14. The design of the incinerator 600 is such that energy is needed only during start-up. Once operational, the solvent will provide enough heat to maintain the burning.

Incinerator 600 can be a catalytic style or any other suitable design. Use of this incinerator 600 will help to insure that the ambient environment surrounding the system 10 does not become polluted with alcohol. The incinerator 600 can be located in a separate location from the remainder of system 10. For example, the system 10 can be within a factory while the incinerator can be located outside the building of the factory.

The air make-up system 20 includes an upper level and a lower level. Heated air moving through duct 602 has had alcohol removed therefrom. This air will either move through the upper or lower level of the air make-up system.

The air in duct 602 will be fed to the air handling system 20. This air handling system includes a dehumidifier 604, filter 606, chiller 608 and optional auxiliary heater 610. The heated air in duct 602 will move over the upper or lower level of the humidifier 604. This humidifier 604 is a desiccant type. A circular disk with solid silica crystals provided therearound acts as a dehumidifier. Silica crystals will absorb water from intake air as will be described below. The drum on which the silica crystals are mounted rotates. The drum will move past rubber flaps or another seal from the first level of the dehumidifier to the second level. In the second level, heated air from the duct 602 will blow past the silica crystals on the rotating disk. This heated air will dry the silica crystals. The air will become moisture-laden and will then pass through the air make-up system 20 to an exhaust line 612. This heated moisture-laden air will be vented to the ambient environment. This ambient environment can be within the factory or it can be outside of the factory.

An air inlet line 614 is also provided to the air make-up system 20. Air is first fed into the air make-up system past a chiller 608. This chiller will insure the appropriate temperature of the air. When the air is at a predetermined temperature, it is easier to remove moisture therefrom. After moving through the chiller 608, the air will pass through filter 606 and the second level of the dehumidifier. The silica crystals on the rotating wheel in the desiccant type dehumidifier will have had any moisture thereon removed by the heated air passing through the first level. The intake air in the second tier will then be exposed to dry silica crystals. Any moisture in this air can therefore be removed in the dehumidifier 604. Downstream from dehumidifier 604 in the air make-up system 20 is an optional auxiliary heater 610. When the system is started, this heater 610 can insure that air fed from the air make-up system 20 is properly heated. During continuous operation of the system, this auxiliary heater 610 is not necessary.

From the auxiliary heater 610, treated air passes through duct 616 to the heat exchanger 594. This highly treated air then moves from the heat exchanger through duct 618 to the fan 414 of the means 412 for removing solvent in the flash-off section 14. The heated air from the curing section 16 also moves through the heat exchanger 594 via duct 524. The heat exchanger 594 will transfer heat from the heated air incoming from duct 524 to the air incoming in duct 616. Therefore, the heat exchanger 594 can heat the highly treated air being fed to the flash-off section 14. The heated air from the curing section 16 is vented through duct 596 and does not enter the flash-off section 14 and does not contact the treated air from the air handling system 590. Therefore, only the highly treated air is introduced into the flash-off section 14.

The air inlet line 614, air make-up system 20, duct 616, heat exchanger 594, and duct 618 act as means 620 for feeding air to the flash-off section 14.

As previously described, the fan 414 in the flash-off section 14 will circulate air. As the fan 414 of the means 412 for moving solvent circulates air in the flash-off section 14, this air will become alcohol-laden as noted above. A sensor 436 in the flash-off section 14 will detect when alcohol within the air reaches a predetermined level. Then the means 450 for withdrawing alcohol-laden air from the flash-off section 14 will be activated. Air will be withdrawn through opening 438 and fed through flash-off duct 598 to the incinerator 600 as noted above. It is not until this air is removed that the need arises for replacement air. When replacement air is needed, air will be drawn through the air inlet line 614, the air make-up system 20, duct 616, heat exchanger 594, and duct 618. This air will replace the air in the flash-off section 14 which has been withdrawn by the means 450 for withdrawing alcohol-laden air.

The horizontal return duct 430 to the fan 414 has only schematically been indicated in FIG. 24. As was previously shown in FIG. 16, this duct 430 is actually beneath the upper horizontal duct 418 which is also only schematically shown in FIG. 24. Of course any suitable location for the ducts can be used.

Due to the heat exchanger 594 and the air make-up system 20, the quality of the air including purity, moisture, and temperature within the flash-off section 14 can be controlled.

Air is removed from the flash-off section 14 at 2,000 cubic feet per minute by the means 450 for withdrawing and is sent to the incinerator when alcohol levels are found to be too high.

Except for the entrance and exit to the flash-off section 14, this section is air-tightly sealed. Air is removed through duct 598 and supplied through duct 618 as noted above. Because of this hermetically or air-tightly sealed arrangement, alcohol is prevented from leaking outside system 10 to the factory environment. Any alcohol-laden air which leaks through the entrance 434 is generally held within the coating section 12. Also, any alcohol-laden air which leaks through the exit 432 to the curing section 16 is held in this section. The air which is fed to the heat exchanger 594 through duct 524 can be separated from the air within the curing section 16. This air which is fed through duct 524 moves through the vertical housing 474, and air-infeed duct 520 within the curing section 16. This arrangement, however, could be vented to the air within the curing section 16 if so desired.

The coating section 12, flash-off section 14, and curing section 16 would not only prevent alcohol-laden air from leaking to the factory, these sections are also sealed to prevent ultraviolet light from entering system 10. The only ultraviolet light supplied in the system is from lights 472 in the curing section 16. Therefore, premature curing of the resin can be avoided. If the system 10 were stopped for some period of time, unintentional curing of the resin can be avoided. The only curing which is done is accomplished by the ultraviolet lights 472. The coating section 12 may have glass panels in order to provide easy inspection of this section. These glass panels, however, are coated to prevent entrance of ultraviolet lights into the coating section 12. Sunlight or other light source from the factory would take several days or a week to actually cure the resin. There is a relatively high throughput of resin in the system 10 so that unintentional curing is unlikely to happen. Nonetheless, the system is sealed from ultraviolet light as noted above, in order to prevent this problem.

Driving System

Figure 26:
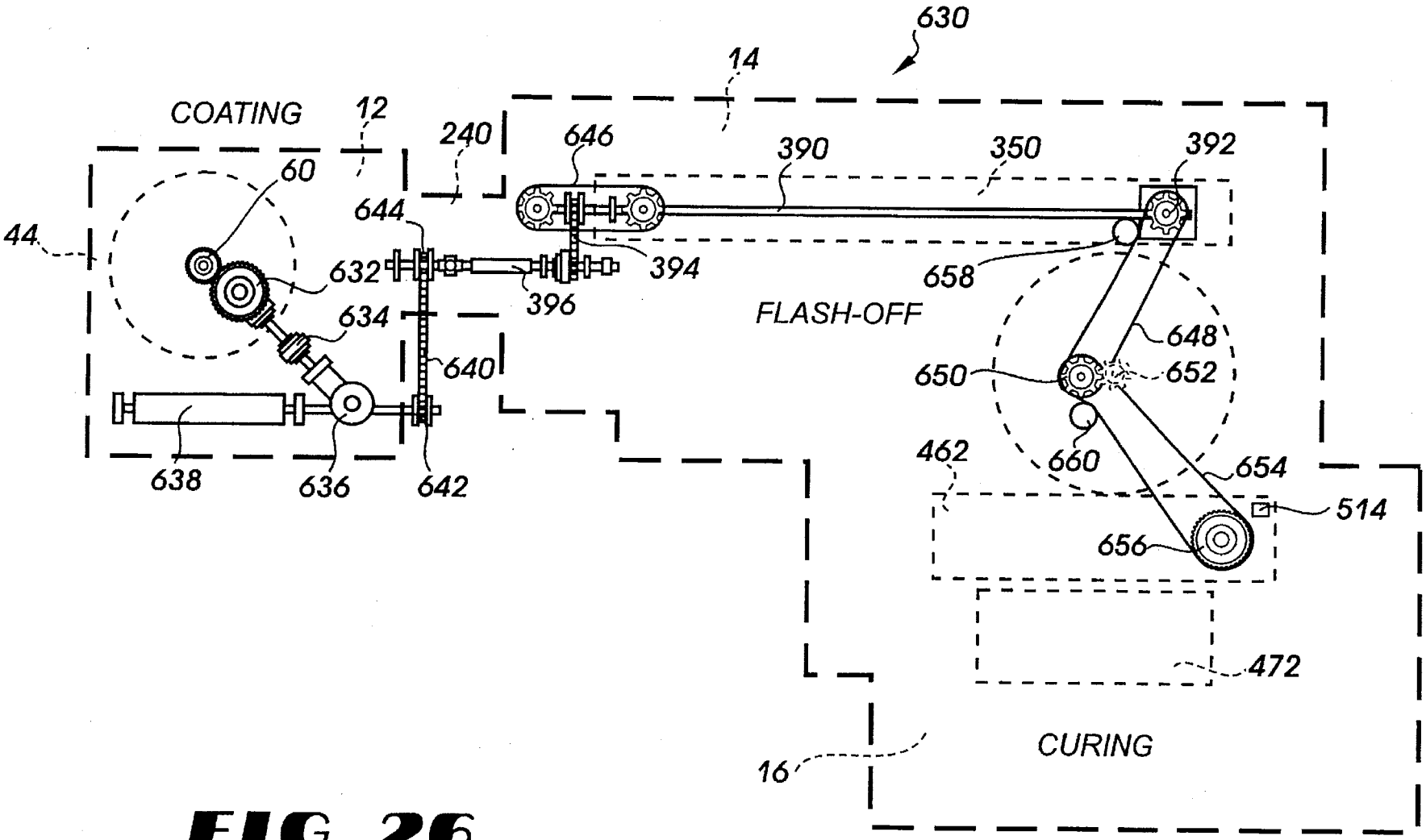
FIG. 26 is a schematic view of the drive means of the present invention.

Turning to FIG. 26, the driving system 630 of the instant invention will now be described. This FIG. 26 schematically indicates the coating section 12, flash-off section 14, and curing section 16.

In the coating section 12, a driving motor 632 is provided. This driving motor 632 is operatively connected to the centrally disposed drive means 60 for the rotatable turntable 44 in coating section 12. Operation of motor 632 will cause the centrally disposed drive means 60 to rotate and therefore rotate turntable 44 with the chucks 40 and containers 46.

Also drivingly connected to the motor 632 is a connection 634. This connection 634 extends to gear box 636. Through this gear box, the first star wheel conveyor 34, second star wheel conveyor 234, and third star wheel conveyor 236 can be driven through a known gearing arrangement. The gear box 636 is also connected to means 638 for driving the spacing auger system 28.

This gear box 636 is also operatively connected to pulley 642. Extending around pulley 642 and pulley 644 is a belt 640. Driving of the motor 630 will cause rotation of the belt 640 through the pulley 642, gear box 636, and connection 634.

Driving of belt 640 will cause pulley 644 to rotate to therefore drive drive rod 396. This drive rod 396 is driven through pulley 394 and connection 646. The geared connection 646 shown in FIG. 26 is different from the pulley connection shown in FIG. 13. It should be appreciated that any suitable drive connection arrangement could be had. Rotation of drive rod 396 will ultimately drive the horizontal drive member 390. Driving of this horizontal drive member 390 will drive the conveyor 350 in the flash-off section 14 as has previously been described.

At the opposite end of the horizontal drive member 390 is gear box 392. This gear box 392 is operatively connected to belt 648 which drives gear 650. Driving of the gear 650 will rotate a second gear 652 to thereby drive the fourth star wheel conveyor 410. Another belt 654 extends between the gear 650 and a gear 656. This gear 656 is used to drive the means 518 for driving conveyor 462 in curing section 16.

Through the driving system 630, a single driving motor 632 can drive the entire system 10. The infeed conveyor 22 and/or discharge conveyor 24 could also be driven through known means or can be drivingly connected to motor 632. As shown in FIG. 26, the motor 630 will drive the centrally disposed drive means 60 in the coating section 12, the spacing auger system 28, the first star wheel conveyor 34, the second star wheel conveyor 234, the third star wheel conveyor 236, the zig-zag conveyor 350, the fourth star wheel conveyor 410, and the conveyor 462 in the curing section 16. In this manner, timing of transport of the bottles 26 throughout the system 10 can be coordinated. Of course, any of these various conveyors could be individually driven or driven in desired groups as is known in the prior art. Sensors 658, 660, and 514 are indicated in FIG. 26 for detecting the speed at which bottles move through system 10. Other sensors can be used throughout the system to work with the control means 18 for controlling movement of bottles through system 10.

Bottles 26 are fed through the system 10 of the instant invention in order to coat their exterior with solution 200 in coating section 12. This solution contains both resin and alcohol. The alcohol is removed in flash-off section 14 and the resin is cured in section 16. It is contemplated that this system 10 will be used with newly manufactured bottles. Problems can occur after bottles are coated whereby additional resin will not easily stick to them. However, in the future, the instant system can be used for coating both existing bottles and newly manufactured bottles.

The instant system and method will enable the coated bottles to maintain a good appearance throughout repeated uses. Coating (resin) can uniformly be applied to the exterior of the bottles. Both the thickness and height of the coating on the bottles will be standardized. Also, coating is recycled throughout the system in order to minimize cost and conserve coating. Space requirements for this system and method are minimized so that the system 10 can be introduced into the existing product production lines. The processing time for coating the bottles is minimized while the rate of bottle flow through the system can be easily varied. Because of the unified drive system 630 and the adjustment means 512 for the ultraviolet lights 472 in the curing section 16, it is easy to control the throughput of bottles in the instant system. It is contemplated that the system 10 will throughput between 80–100 bottles a minute. The control 18 can very easily vary the throughput. In fact, a general control for 80, 85, 90, 95, or 100 bottles per minute can be provided with fine tuning of this general control such that any desired throughput speed can be selected. Therefore, the output is easily varied with the instant system 10.

Accordingly, in the instant system 10, a coating section 12, flash-off section 14, and curing section 16 are provided. The coating section has means 42 for dipping bottles in a solution 200 of alcohol and resin. This means 42 will coat the exterior of the bottles 26. In the flash-off section 14, a conveyor 350 will receive bottles and means 412 will remove solvent such as alcohol from the exterior of the bottles. In the curing section 16, conveyor 462 will receive bottles from the flash-off section 14. Means 468 are provided for curing resin on the exterior of the bottles.

The instant invention also provides for a method for adhering resin to bottles. This method comprises the steps of supplying bottles to the coating section 12. The bottles are dipped in the coating section in a solution 200 of resin and alcohol. The bottles are removed from this solution and the gripping is terminated. The bottles are then transferred to flash-off section 14 and conveyed through this section on conveyor 350. Alcohol is removed from the exterior of the bottles during this conveying. The bottles are then transferred from the flash-off section 14 to the curing section 16. In the curing section, resin on the exterior of the bottles is cured. Finally, the bottles are discharged from the curing section.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A method for adhering resin to bottles comprising the steps of:

supplying bottles to a coating section;

providing a plurality of containers in the coating section;

gripping the bottles within the coating section;

dipping the bottles into a solution of resin and solvent in the coating section after the bottles are gripped in the coating section, the bottles being individually dipped into one of the plurality of containers with only one bottle being simultaneously received in one of the containers;

removing the bottles from the solution;

terminating the gripping of the bottles after the bottles are removed from the solution;

transferring the bottles to a flash-off section after gripping is terminated;

conveying the bottles through the flash-off section;

removing solvent from an exterior of the bottles during conveying of the bottles through the flash-off section;

transferring the bottles from the flash-off section to a curing section;

curing resin on the exterior of the bottles in the curing section; and discharging the bottles from the curing section.

2. The method as recited in claim 1, further comprising the steps of:

providing the plurality of containers on a turntable in the coating section;

supplying the solution of resin and solvent to the plurality of containers;

rotating the turntable with the containers;

the step of gripping including engaging the bottles with chucks, the chucks holding the bottles during dipping of the bottles into a solution of resin and solvent in the coating section, each of the bottles being dipped into one of the containers on the turntable during the step of dipping such that only an exterior of the bottles are coated with solution; and simultaneously rotating the chucks with the containers on the turntable.

3. The method as recited in claim 2, further comprising the steps of:

vertically lowering the chucks and bottles during dipping of the bottles; and vertically raising the chucks and bottles during removing of the bottles from the solution.

4. The method as recited in claim 2, further comprising the step of controlling a depth of solution in the containers, the solution overflowing from the container when supplied to the container in excess of a maximum depth.

5. The method as recited in claim 2, wherein the step of supplying the solution of resin and solvent to the plurality of containers includes the step of jetting the solution through an opening provided in the bottom of each of the containers and wherein the method further comprises the step of removing air entrapped beneath the bottles when the bottles are dipped into the solution, the air being removed by the solution being jetted into the bottom of the containers, an exterior of the bottles being immersed in the solution in the containers whereby the immersed exterior can be completely coated.

6. The method as recited in claim 1, wherein the step of conveying in the flash-off section includes the step of moving the bottles along an elongated spiral path, the bottles moving along flights of a conveyor with downstream flights overlying upstream flights of the conveyor.

7. The method as recited in claim 1, wherein the step of conveying in the flash-off section includes the step of moving the bottles along a zig-zag path.

8. The method as recited in claim 1, further comprising the steps of:

providing a drip tray beneath the bottles in the flash-off section;

catching solution dripping from the bottles in the drip tray; and returning the solution from the drip tray to the coating section.

9. The method as recited in claim 1, wherein the step of removing solvent in the flash-off section comprises the step of passing air over the bottles being conveyed in the flash-off section.

10. The method as recited in claim 9, further comprising the steps of:

providing a sensor in the flash-off section for detecting an amount of solvent in the air in the flash-off section;

withdrawing air from the flash-off section in response to the sensor activating an air withdrawing device; and replacing air withdrawn from the flash-off section with solvent-free air.

11. The method as recited in claim 1, wherein the step of curing comprises the steps of:

providing ultraviolet lights in the curing section; and conveying the bottles on a conveyor past the ultraviolet lights in the curing section, the bottles being exposed to the light from the ultraviolet lights.

12. The method as recited in claim 11, further comprising the steps of:

providing the ultraviolet lights on a support; and moving the support toward and away from the conveyor to thereby move the lights closer to and further from the bottles being conveyed, the step of moving the support comprises, moving the support and lights closer to the conveyor when speed of the conveyor increases, and moving the support and lights further from the conveyor when speed of the conveyor decreases.

13. The method as recited in claim 12, further comprising the step of vertically moving the support to accommodate different heights of bottles being conveyed through the curing section.

14. The method as recited in claim 11, wherein the step of providing ultraviolet lights includes the steps of:

positioning at least one light beneath the bottles being conveyed in the curing section to thereby cure resin on the bottom of the bottles; and positioning at least one light at an incline, ultraviolet light from the inclined light being directed to a slanted portion of a neck of the bottles being conveyed through the curing section.

15. The method as recited in claim 11, wherein the step of conveying the bottles in the curing section includes gripping the bottles with chucks, each of the chucks having a longitudinal axis and wherein the method further comprises the step of rotating the chucks about their longitudinal axes when the bottles gripped by the chucks move past the ultraviolet lights, the bottles gripped by the chucks being rotated about a generally vertical axis when moving past the ultraviolet lights.

16. The method as recited in claim 1, wherein the bottles have a generally cylindrical shape and wherein each of the containers has a generally cylindrical shape conforming to the shape of the bottles but having a larger diameter than the bottles, and wherein the step of dipping comprises immersing a portion of the bottles in the solution.

17. The method as recited in claim 16, wherein the method further comprises the steps of:

overflowing solution from the containers when the bottles are dipped therein; and replacing solution to the containers after the solution has overflown therefrom such that a fresh supply of solution is provided for the containers.

18. The method as recited in claim 1, wherein the method further comprises the steps of:

overflowing solution from the containers when the bottles are dipped therein; and replacing solution to the containers after the solution has overflown therefrom such that a fresh supply of solution is provided for the containers.

19. The method as recited in claim 1, further comprising the steps of:

supplying the solution to the plurality of containers by jetting the solution through an opening provided in the bottom of each of the containers; and removing air entrapped beneath the bottles when the bottles are dipped into the solution, the air being removed by the solution being jetted into the bottom of the containers, an exterior of the bottles being immersed in the solution in the containers whereby the immersed exterior can be completely coated.

20. A method for adhering resin to bottles comprising the steps of:

supplying bottles to a coating section;

gripping the bottles within the coating section;

dipping the bottles into a solution of resin and solvent in the coating section after the bottles are gripped in the coating section;

removing the bottles from the solution;

terminating the gripping of the bottles after the bottles are removed from the solution;

transferring the bottles to a flash-off section after gripping is terminated;

conveying the bottles along a non-linear path through the flash-off section by moving the bottles along an elongated spiral path, the bottles moving along flights of a conveyor with sequential flights of the conveyor overlying one another;

removing solvent from an exterior of the bottles during conveying of the bottles through the flash-off section, the step of removing including passing air over the bottles;

treating the air entering the flash-off section with an air make-up system, the air make-up system including an air chiller, a dehumidifier and a filter for treating the air;

transferring the bottles from the flash-off section to a curing section;

curing resin on the exterior of the bottles in the curing section; and discharging the bottles from the curing section.

21. The method as recited in claim 20, further comprising the steps of:

providing the plurality of containers on a turntable in the coating section;

supplying the solution of resin and solvent to the plurality of containers;

rotating the turntable with the containers;

the step of gripping including engaging the bottles with chucks, the chucks holding the bottles during dipping of the bottles into a solution of resin and solvent in the coating section, each of the bottles being dipped into one of the containers on the turntable during the step of dipping such that only an exterior of the bottles are coated with solution; and simultaneously rotating the chucks with the containers on the turntable.

22. The method as recited in claim 21, further comprising the steps of:

vertically lowering the chucks and bottles during dipping of the bottles; and vertically raising the chucks and bottles during removing of the bottles from the solution.

23. The method as recited in claim 21, further comprising the step of controlling a depth of solution in the containers, the solution overflowing from the container when supplied to the container in excess of a maximum depth.

24. The method as recited in claim 21, wherein the step of supplying the solution of resin and solvent to the plurality of containers includes the step of jetting the solution through an opening provided in the bottom of each of the containers and wherein the method further comprises the step of removing air entrapped beneath the bottles when the bottles are dipped into the solution, the air being removed by the solution being jetted into the bottom of the containers, an exterior of the bottles being immersed in the solution in the containers whereby the immersed exterior can be completely coated.

25. The method as recited in claim 20, wherein the step moving the bottles along an elongated spiral path in the step of conveying comprises raising the bottles along an upward path with downstream flights of the conveyor overlying upstream flights of the conveyor.

26. The method as recited in claim 20, wherein the step of conveying along the non-linear path in the flash-off section includes the step of moving the bottles along a zig-zag path.

27. The method as recited in claim 20, further comprising the steps of:

providing a drip tray beneath at least a majority of the elongated spiral path on which the bottles move in the flash-off section;

catching solution dripping from the bottles in the drip tray; and returning the solution from the drip tray to the coating section.

28. The method as recited in claim 20, further comprising the steps of:

providing a sensor in the flash-off section for detecting an amount of solvent in the air in the flash-off section;

withdrawing air from the flash-off section in response to the sensor activating an air withdrawing device; and replacing air withdrawn from the flash-off section with solvent-free air.

29. The method as recited in claim 20, wherein the step of curing comprises the steps of:

providing ultraviolet lights in the curing section; and conveying the bottles on the conveyor past the ultraviolet lights in the curing section, the bottles being exposed to the light from the ultraviolet lights.

30. The method as recited in claim 29, further comprising the steps of:

providing the ultraviolet lights on a support; and moving the support toward and away from the conveyor to thereby move the lights closer to and further from the bottles being conveyed, the step of moving the support comprises, moving the support and lights closer to the conveyor when speed of the conveyor increases, and moving the support and lights further from the conveyor when speed of the conveyor decreases.

31. The method as recited in claim 30, further comprising the step of vertically moving the support to accommodate different heights of bottles being conveyed through the curing section.

32. The method as recited in claim 29, wherein the step of providing ultraviolet lights includes the steps of:

positioning at least one light beneath the bottles being conveyed in the curing section to thereby cure resin on the bottom of the bottles; and positioning at least one light at an incline, ultraviolet light from the inclined light being directed to a slanted portion of a neck of the bottles being conveyed through the curing section.

33. The method as recited in claim 29, wherein the step of conveying the bottles in the curing section includes gripping the bottles with chucks, each of the chucks having a longitudinal axis and wherein the method further comprises the step of rotating the chucks about their longitudinal axes when the bottles gripped by the chucks move past the ultraviolet lights, the bottles gripped by the chucks being rotated about a generally vertical axis when moving past the ultraviolet lights.

34. A method for adhering resin to bottles comprising the steps of:

supplying bottles to a coating section;

gripping the bottles within the coating section;

dipping the bottles into a solution of resin and solvent in the coating section after the bottles are gripped in the coating section;

removing the bottles from the solution;

terminating the gripping of the bottles after the bottles are removed from the solution;

transferring the bottles to a flash-off section after gripping is terminated;

conveying the bottles through the flash-off section;

removing solvent from an exterior of the bottles during conveying of the bottles through the flash-off section;

transferring the bottles from the flash-off section to a curing section;

curing resin on the exterior of the bottles in the curing section with ultraviolet lights;

conveying the bottles on a conveyor past the ultraviolet lights in the curing section, the bottles being exposed to ultraviolet light from the ultraviolet lights during at least a portion of the step of conveying;

moving the ultraviolet lights toward and away from the bottles in the curing section, the step of moving the ultraviolet lights comprises moving the lights closer to the conveyor when speed of the conveyor increases, and moving the lights further from the conveyor when speed of the conveyor decreases; and discharging the bottles from the curing section.

35. The method as recited in claim 34, further comprising the steps of:

providing the plurality of containers on a turntable in the coating section;

supplying the solution of resin and solvent to the plurality of containers;

rotating the turntable with the containers;

the step of gripping including engaging the bottles with chucks, the chucks holding the bottles during dipping of the bottles into a solution of resin and solvent in the coating section, each of the bottles being dipped into one of the containers on the turntable during the step of dipping such that only an exterior of the bottles are coated with solution; and simultaneously rotating the chucks with the containers on the turntable.

36. The method as recited in claim 35, further comprising the steps of:

vertically lowering the chucks and bottles during dipping of the bottles; and vertically raising the chucks and bottles during removing of the bottles from the solution.

37. The method as recited in claim 35, further comprising the step of controlling a depth of solution in the containers, the solution overflowing from the container when supplied to the container in excess of a maximum depth.

38. The method as recited in claim 35, wherein the step of supplying the solution of resin and solvent to the plurality of containers includes the step of jetting the solution through an opening provided in the bottom of each of the containers and wherein the method further comprises the step of removing air entrapped beneath the bottles when the bottles are dipped into the solution, the air being removed by the solution being jetted into the bottom of the containers, an exterior of the bottles being immersed in the solution in the containers whereby the immersed exterior can be completely coated.

39. The method as recited in claim 34, wherein the step of conveying in the flash-off section includes the step of moving the bottles along an elongated spiral path, the bottles moving along flights of a conveyor with downstream flights overlying upstream flights of the conveyor.

40. The method as recited in claim 34, wherein the step of conveying in the flash-off section includes the step of moving the bottles along a zig-zag path.

41. The method as recited in claim 34, further comprising the steps of:

providing a drip tray beneath the bottles in the flash-off section;

catching solution dripping from the bottles in the drip tray; and returning the solution from the drip tray to the coating section.

42. The method as recited in claim 34, wherein the step of removing solvent in the flash-off section comprises the step of passing air over the bottles being conveyed in the flash-off section.

43. The method as recited in claim 42, further comprising the steps of:

providing a sensor in the flash-off section for detecting an amount of solvent in the air in the flash-off section;

withdrawing air from the flash-off section in response to the sensor activating an air withdrawing device; and replacing air withdrawn from the flash-off section with solvent-free air.

44. The method as recited in claim 34, further comprising the step of vertically moving the support to accommodate different heights of bottles being conveyed through the curing section.

45. The method as recited in claim 34, further comprising the steps of:

positioning at least one ultraviolet light beneath the bottles being conveyed in the curing section to thereby cure resin on the bottom of the bottles; and positioning at least one ultraviolet light at an incline, ultraviolet light from the inclined light being directed to a slanted portion of a neck of the bottles being conveyed through the curing section.

46. The method as recited in claim 34, wherein the step of conveying the bottles in the curing section includes gripping the bottles with chucks, each of the chucks having a longitudinal axis and wherein the method further comprises the step of rotating the chucks about their longitudinal axes when the bottles gripped by the chucks move past the ultraviolet lights, the bottles gripped by the chucks being rotated about a generally vertical axis when moving past the ultraviolet lights.

* * * * *